US005930550A

United States Patent [19]

Tanaka

[11] Patent Number: 5,930,550

[45] Date of Patent: Jul. 27, 1999

[54] PROCESSING AGENT INTRODUCING APPARATUS

[75] Inventor: Katsuhiko Tanaka, Kanagawa, Japan

[73] Assignee: Fuji Photo Film Co., Ltd., Kanagawa, Japan

[21] Appl. No.: 08/946,923

[22] Filed: Oct. 8, 1997

[30] Foreign Application Priority Data

Oct. 9, 1996 [JP] Japan ..... 8-268888
Feb. 28, 1997 [JP] Japan ..... 9-046238

[51] Int. Cl.[6] ..... G03D 3/02

[52] U.S. Cl. ..... 396/627; 396/661

[58] Field of Search ..... 396/661, 626, 396/627; 134/62, 61, 104.2, 166 R, 167 R, 168 R, 22.1; 222/64; 137/240; 141/91, 141; 239/248, 251, 556

[56] References Cited

U.S. PATENT DOCUMENTS 4,160,457 7/1979 Dickson, Jr. et al. ..... 134/167 R
4,186,759 2/1980 Stevenson et al. ..... 137/166 R
4,406,298 9/1983 Martin ..... 134/167 R
4,715,538 12/1987 Lingnau ..... 239/248
5,497,813 3/1996 Dinnis et al. ..... 141/329
5,579,787 12/1996 Wood ..... 134/167 R
5,640,643 6/1997 Hoitz et al. ..... 396/661

*Primary Examiner*—D. Rutledge
*Attorney, Agent, or Firm*—Sughrue, Mion, Zinn, Macpeak & Seas, PLLC

[57] ABSTRACT

The present invention provides a processing agent introducing apparatus for use in a photosensitive material processing apparatus processing a photosensitive material. The processing agent introducing apparatus comprises a reservoir tank for reservoiring processing agent for replenishment, holding means for holding a container in which replenisher is sealed while a sealed opening of the container is directed downward, and an unsealing member for unsealing the container and for flowing the processing agent in the container into the reservoir tank, wherein the unsealing member has a plurality of jet openings jetting a cleaning liquid for cleaning an inner wall of the container in different directions. Accordingly, a plurality of jet openings jet the cleaning liquid in different directions so as to shoot the cleaning liquid on plural positions in the container. Thus, the apparatus of the present invention has less cleaning non-uniformity than the apparatus which shoots the cleaning liquid on one position.

18 Claims, 19 Drawing Sheets

PROCESSING AGENT INTRODUCING APPARATUS

BACKGROUND OF THE INVENTION

1. Field of the Invention

The present invention relates to a processing agent introducing apparatus which is used for a photosensitive material processing apparatus such as an automatic developing machine and allows a processing agent for replenishment to flow out of a container filled with the processing agent so as to supplement or introduce the processing agent into the photosensitive material processing apparatus.

2. Description of the Related Art

A photographic film or a photographic paper for color print is processed in an automatic developing machine (for example, a photographic film processor, a printer processor or the like) for use in a laboratory.

The film or the paper is carried and processed in a plurality of processing tanks filled with processing solutions for color development, bleach fixing, washing, stabilization or the like and water.

A composition and an amount of the processing solution in each tank vary depending on the process of the film or paper. Thus, each processing tank is replenished with fresh solution or replenisher from a replenishing tank in response to the amount of process.

Furthermore, in such a system, a sensor detects a reduction of replenisher so as to display and warn a user to supply replenisher to the replenishing tank.

Recently, there is proposed the processing agent introducing apparatus in which the container is automatically unsealed by setting the container filled with replenisher or processing solution for replenishment in the apparatus, the replenisher or processing solution is automatically introduced into the replenishing tank, and the container or bottle filled with the replenisher or the solution is then cleaned by a cleaning solution jetted from a cleaning nozzle.

However, the conventional cleaning nozzle is so constructed that the cleaning solution is jetted from one point or one opening. Therefore, cleaning properties are inferior, and a cleaning range is also limited. Thus, a great amount of cleaning solution is necessary for the cleaning.

If the replenisher is the processing solution for replenishment have a high concentration and is in a slurry state, it is difficult to remove the same solution adhered to an inside in the container. A large amount of residual solution in the container would have an adverse effect on replenishing accuracy and introducing accuracy. This causes a problem that solution controlling accuracy is deteriorated.

Accordingly, in order to correctly maintain the replenishing accuracy and introducing accuracy, it is necessary to reduce the residual solution in a replenisher bottle, that is, the container. More specifically, when the replenisher and the processing solution for replenishment is concentrated solution, this has such a great influence that the reduction of developing performance is caused.

Moreover, the residual solution remains in the container after the cleaning. Thus, there is arisen another problem that a liquid drip occurs during a removal of the container or the like.

SUMMARY OF THE INVENTION

The present invention is accomplished in view of the aforementioned facts. It is an object of the present invention to provide a processing agent introducing apparatus or a processing agent replenishing which can clean an inside of a container for replenisher by the use of a small amount of cleaning solution.

It is another object of the present invention to provide a processing agent introducing apparatus which can prevent a liquid drip during a removal of the container or the like by efficiently drying the container.

According to a first aspect of the present invention, there is provided a processing agent introducing apparatus for use in a photosensitive material processing apparatus for processing a photosensitive material, which comprises a reservoir tank for reserving a processing agent, holding means for holding a container in which the processing agent is contained and sealed while a sealed opening of the container is directed downward, and an unsealing member for unsealing the sealed opening and for flowing the processing agent contained in the container into the reservoir tank, wherein the unsealing member has a plurality of jet openings jetting cleaning solution for cleaning an inner wall of the container in different directions.

An operation of the processing agent introducing apparatus according to the first aspect will be described below.

In order to replenishing the reservoir tank with the processing agent, the container filled with the processing agent is first inverted. The container is held by the holding means in the state that the sealed opening thereof is directed downward. Next, when the sealed opening is unsealed by the unsealing means, the processing agent in the container flows from the unsealed opening so that the processing agent is introduced into or is replenished to the reservoir tank. The container may be held in an inclined state, as long as the processing agent naturally flows from the unsealed opening.

The processing agent adhered to the inner surface of the container remains. Thus, the cleaning solution is jetted from the jet openings of the unsealing member progressed in the container into the container, whereby it is possible to wash off the processing agent adhered to the inner surface of the container. The cleaning solution is jetted from the plurality of jet openings in different directions so that the cleaning solution may be directly shot to a plurality of positions on the inner surface of the container. Therefore, the apparatus of the present invention has less cleaning non-uniformity than the apparatus which shoots the cleaning solution on one position of the inner wall. It is possible to efficiently clean the container by the use of a small amount of cleaning solution.

The processing agent may be a liquid such as a medical fluid, water and oil. A fine particle (such as a powder) may be dispersed in these liquids. The processing agent may be in a slurry state. The processing agent maybe a solid matter such as a tablet, a capsule and the powder.

The cleaning solution may be the water. The cleaning solution may be the liquid other than the water. The cleaning solution may be a diluted water for diluting the processing agent.

According to a second aspect, there is provided the processing agent introducing apparatus according to the first aspect, wherein one of the plurality of jet openings is directed so that it may jet the cleaning solution along a center axis of the unsealing member or the center axis of the container.

The operation of the processing agent introducing apparatus according to the second aspect will be described below.

In the processing agent introducing apparatus of the second aspect, one of plural jet openings jets the cleaning solution along the center axis of the unsealing member or the center axis of the container. The remaining jet openings jet the cleaning solution in other directions.

For example, when one of jet openings jets the cleaning solution along the center axis of the unsealing member, the container is held so that the center axis of the container may match with the center axis of the unsealing member. Thus, the processing solution is directly jetted onto the bottom surface of the container. Cleaning properties are improved on the bottom surface of the container.

The container is held in the inclined state so that the center axis of the container may be inclined with respect to the center axis of the unsealing member. In this case, when one of jet openings is allowed to jet the cleaning solution along the center axis of the container, the cleaning solution can be directly jetted on the bottom surface of the container. The cleaning properties are improved on the bottom surface of the container.

According to a third aspect, there is provided the processing agent introducing apparatus according to the first or second aspect, wherein a direction and/or directions to jet the cleaning solution are set in the range of 45° or less and/or of 90° or more with respect to the center axis of the unsealing member or the center axis of the container held by the holding means.

The operation of the processing agent introducing apparatus according to the third aspect will be described below.

In the processing agent introducing apparatus of the third aspect, the cleaning solution is jetted in the range of 45° or less and/or of 90° or more with respect to the center axis of the unsealing member or the center axis of the container held by the holding means.

When the cleaning solution is jetted in the range of 45° or less with respect to the center axis of the unsealing member or the center axis of the container held by the holding means, the cleaning solution is directly shot on the inner wall of the container from the upper side to the oblique upper side so as to clean the container. After that time, the cleaning solution partially drops down along the side wall so as to clean all over the side wall.

On the other hand, when the cleaning solution is jetted in the range of 90° or more with respect to the center axis of the unsealing member or the center axis of the container held by the holding means, the cleaning solution directly is shot on the inner wall surface of the container around the opening so as to clean the container. The cleaning solution dropping down along the side wall collides with the cleaning solution jetted in the range of 90° or more with respect to the center axis of the unsealing member or the center axis of the container held by the holding means. This causes a turbulent flow. Therefore, a cleaning effect is further improved on the inner wall surface around the opening.

When the cleaning solution is jetted in the range exceeding 45°, the cleaning solution is easy to spread in a hollow circle shape. Since a cleaning capability is reduced at the center portion, the angle exceeding 45° is not preferable.

When the cleaning solution is jetted in the range less than 90°, the cleaning solution cannot be shot on the periphery of the opening. It is not possible to improve the cleaning effect on the inner wall surface around the opening. When the cleaning solution can be jetted backward in the range of 90° or more, even if the unsealing member is deeply inserted into the container, the periphery of the opening can be cleaned. Even if an amount of insertion is not adjusted precisely, a cleaning efficiency can be improved. Moreover, when the amount of insertion is deeper, an outward leakage of the cleaning solution is reduced. Thus, contamination is not leaked outward.

According to a fourth aspect, there is provided a processing agent introducing apparatus for use in a photosensitive material processing apparatus for processing a photosensitive material, for opening a sealing member or a bottle closing member of a processing agent container to introduce processing agent for replenishment filled in the processing agent container into a replenishing tank, which comprises a load section which is loaded with the processing agent container, an unsealing member for opening the sealing member, driving means for moving at least one of the loading section and the unsealing member so as to insert the unsealing member into the processing agent container through the sealing member withdraw the unsealing member from the processing agent container, and controlling means for controlling the driving means based on an operation condition of the photosensitive material processing apparatus.

The operation of the processing agent introducing apparatus according to the fourth aspect will be described below.

In the processing agent introducing apparatus of the fourth aspect, at least one of the load section and the unsealing member is moved by the driving means in such a direction that the container and the unsealing member approach each other. At that time, the unsealing member is inserted into the container so as to break and open the sealing member, thereby allowing the processing agent to flow out. After the unsealing, the withdrawal of the unsealing member is controlled and automatically performed based on the operation condition of the photosensitive material processing apparatus by the controlling means.

According to a fifth aspect, there is provided a processing agent introducing apparatus for use in a photosensitive material processing apparatus processing a photosensitive material, for opening a sealing member of a processing agent container to introduce processing agent for replenishment filled in the processing agent container into a replenishing tank, which comprises a load section which is loaded with the processing agent container, an unsealing member for opening the sealing member, driving means for moving at least one of the load section and the unsealing member, for inserting the unsealing member into the processing agent container through the sealing member and for withdrawing the unsealing member from the processing agent container, environment detecting means for detecting environment condition, and controlling means for, after opening of the sealing member has been effected by the unsealing member, controlling the withdrawal of the unsealing member from the processing agent container in response to the environment condition which has been detected by the environment detecting means.

The operation of the processing agent introducing apparatus according to the fifth aspect will be described below.

In the processing agent introducing apparatus of the fifth aspect, the at least one of the load section and the unsealing member is moved by the driving means in such a direction that the sealing member and the unsealing member approach each other. At that time, the unsealing member is inserted into the container so as to break and open the sealing member, thereby allowing the processing agent to flow out.

After sealing member is opened, the environment condition is detected by the environment detecting means. The environment condition includes at least one of the temperature and the humidity.

The controlling means can control the withdrawal of the unsealing member in response to the detected environment condition after the sealing member is opened. For example, when the environment is in a condition that the water is easy to dry, the unsealing member remains inserted in the processing agent container. Thus, the sealing member remains open. The dry in the container is promoted. During the removal of the container, the liquid drip can be prevented.

On the other hand, when the environment is in a condition that the water is difficult to dry, the unsealing member is pulled out of the processing agent container immediately after the flowing-out of the processing agent. When the sealing member is made of an elastic member, the unsealing member is pulled out so as to close the cap. The processing agent container can be substantially closed. During the removal of the container, the liquid drip can be prevented.

According to a sixth aspect, there is provided the processing agent introducing apparatus according to the fifth aspect, in which the controlling means controls the driving means so that the unsealing member may be withdrawn from the processing agent container after unsealing when the environment condition which has been detected by the environment detecting means is in a condition of a low temperature and/or a high humidity.

The operation of the processing agent introducing apparatus according to the sixth aspect will be described below.

In the processing agent introducing apparatus of the sixth aspect, when the environment condition is in a condition of the low temperature and/or the high humidity, the unsealing member is withdrawn from the processing agent container as soon as the sealing member is opened or unsealed. When the cap is made of the elastic member, the unsealing member is pulled out so as to close the sealing member. The processing agent container can be substantially closed.

When the environment is in a condition of the low temperature or/and high humidity, ambient air is difficult to enter the processing agent container. The dry is difficult to promote in the processing agent container. However, since the unsealing member is withdrawn at an early timing, each breaking piece of the broken sealing member have high restoring force. Thus, close properties become excellent. That is, the close properties of the processing agent container or the sealing member are increased, whereby the liquid drip can be prevented during the removal of the container.

According to a seventh aspect, there is provided the processing agent introducing apparatus according to the fifth aspect, in which the controlling means controls the driving means so as to maintain a condition that the unsealing member is inserted in the processing agent container after the unsealing when the environment condition which has been detected by the environment detecting means is in a condition of a high temperature and/or a low humidity.

The operation of the processing agent introducing apparatus according to the seventh aspect will be described below.

In the processing agent introducing apparatus of the seventh aspect, when the environment condition is in a condition of the high temperature and/or the low humidity, such a condition is maintained that the unsealing member remains inserted in the processing agent container after unsealing the sealing member.

In this case, since the sealing member remains open, the ambient air is easy to enter the processing agent container. The drying in the processing agent container is promoted. That is, the processing agent container is efficiently dried. The liquid drip can be prevented during the removal of the container.

According to an eighth aspect, there is provided a processing agent introducing apparatus for use in a photosensitive material processing apparatus processing a photosensitive material, for opening or unsealing a sealing member of a processing agent container to introduce processing agent for replenishment filled in the processing agent container into a replenishing tank, which comprises a load section which is loaded with the processing agent container, an unsealing member for unsealing the sealing member, driving means for moving at least one of the load section and the unsealing member, for inserting the unsealing member into the processing agent container through the sealing member and for withdrawing the unsealing member from the processing agent container, cleaning means for cleaning the inside of the processing agent container by a cleaning liquid or water, a cleaning liquid tank for reserving the cleaning liquid, cleaning liquid level detecting means for detecting a level of the cleaning liquid in the cleaning liquid tank; and controlling means for prohibiting the operation of the driving means when the level of the cleaning liquid in the cleaning solution tank is a predetermined level or less.

The operation of the processing agent introducing apparatus according to the eighth aspect will be described below.

In the processing agent introducing apparatus of the eighth aspect, at least one of the processing agent container filled with the processing agent and the unsealing member is moved by the driving means in such a direction that they approach each other. At that time, the unsealing member is inserted into the container so as to break and open or unseal the sealing member, thereby allowing the processing agent to flow out.

Furthermore, after the flow of the processing agent, the cleaning means can clean the inside of the processing agent container by the cleaning liquid.

On the other hand, when an amount of residual cleaning water or liquid is low (equal to or less than a predetermined level), a controlling device prohibits the operation of the driving means so as not to open the sealing member. This is performed because, due to the shortage of the cleaning liquid or water during the cleaning, the cleaning is required again, the drying of the processing agent container is not promoted and a cleaning efficiency is reduced. Therefore, the cleaning water is supplied so as to increase the amount of residual cleaning water, thereafter allowing the sealing member to be unsealed.

According to a ninth aspect, there is provided a processing agent introducing apparatus for use in a photosensitive material processing apparatus processing a photosensitive material, for opening a sealing member of a processing agent container to introduce processing agent for replenishment filled in the processing agent container into a replenishing tank, which comprises a load section which is loaded with the processing agent container, an unsealing member for opening the sealing member, driving means for moving at least one of the loading section and the unsealing member, for inserting the unsealing member into the processing agent container through the sealing member and for withdrawing the unsealing member from the processing agent container, cleaning means for cleaning the inside of the processing agent container by cleaning liquid, the replenishing tank for reserving the processing agent, processing agent level detecting means for detecting a level of the processing agent in the replenishing tank, and controlling means for prohibiting the operation of the driving means when the level of the processing agent in the replenishing tank is a predetermined level or more.

The operation of the processing agent introducing apparatus according to the ninth aspect will be described below.

In the processing agent introducing apparatus of the ninth aspect, at least one of the processing agent container filled with the processing agent and the unsealing member is moved by the driving means in such a direction that they approach each other. At that time, the unsealing member is inserted into the container so as to break and open the sealing member, thereby allowing the processing agent to flow out.

Furthermore, after the flow of the processing agent, the cleaning means can clean the inside of the processing agent container by the cleaning liquid.

When the level is high in the replenishing tank (equal to or more than a predetermined level), the controlling device prohibits the operation of the driving means so as not to open the sealing member. When the sealing member is opened in this state, the replenishing tank may be overflowed. Even if the overflow does not occur at the introduction of the processing agent, when the cleaning water is used as the diluted water, there is a high possibility that the overflow is caused by the diluted water. Thus, the sealing member is not opened.

Moreover, when the sealing member is opened and the container cleaning is in a stand-by state prior to the reduction of the level of the processing agent in the replenishing tank, the processing agent is tightly adhered to the processing agent container. This results in the deterioration of cleaning effect. Furthermore, since it takes much time to dry the processing agent container, this is not preferable.

According to a tenth aspect, there is provided a processing agent introducing apparatus for use in a photosensitive material processing apparatus processing a photosensitive material, for opening a sealing member of a processing agent container to introduce processing agent for replenishment filled in the processing agent container into a replenishing tank, which comprises a plurality of load sections each of which is loaded with the processing agent container, an unsealing member for opening the sealing member, driving means for moving at least one of each load section and the unsealing member, for inserting the unsealing member into the processing agent container through the sealing member and for withdrawing the unsealing member from the processing agent container, container detecting means for detecting whether or not the processing agent container is loaded in each loading section, and controlling means for prohibiting the operation of the driving means while it is not detected that the processing agent container is loaded in each of the plurality of loading sections.

The operation of the processing agent introducing apparatus according to the tenth aspect will be described below.

In the processing agent introducing apparatus of the tenth aspect, while the container detecting means does not detect that the processing agent container is loaded in each of the plurality of loading sections, the controlling device prohibits the operation of the driving means so as not to open the sealing member.

This is performed in order to determine the replenishing timing for replenishing the corresponding processing agent into each processing tank. When all of the load sections are loaded with the processing agent containers, the sealing members of all the processing agent containers can be opened. Thus, it is possible to reduce the number of times of the supply. It is easier to use the apparatus.

DETAILED DESCRIPTION OF THE PREFERRED EMBODIMENTS

Embodiment 1

A photosensitive material processing apparatus applying processing agent introducing apparatus of a first embodiment will be described with reference to FIGS. 1 through 4.

Figure 1:
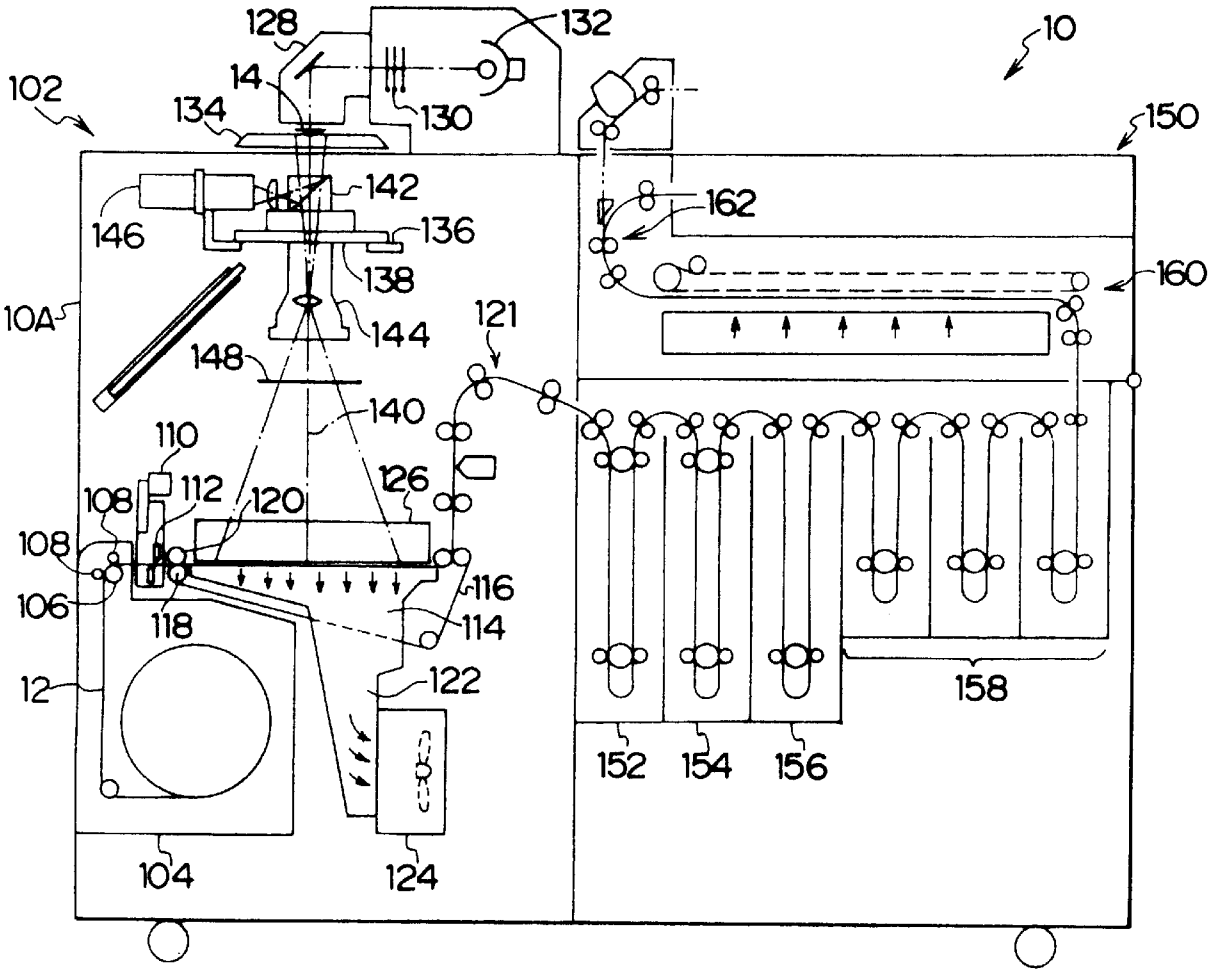
FIG. 1 shows a schematic construction of a photosensitive material processing apparatus applying a processing agent introducing apparatus of a first embodiment.

As shown in FIG. 1, a printer section of a photosensitive material processing apparatus 10 comprises a photograph printing section 102. The photograph printing section 102 is constructed so that it can be loaded with a paper magazine 104 in which a photographic paper 12 is accommodated as a photosensitive material.

A drive roller 106 is disposed on the left upper side of the paper magazine 104 in FIG. 1. A pair of nip rollers 108 are opposite to the drive roller 106. The drive roller 106 and nip rollers 108 nip the photographic paper 12 so as to feed the photographic paper 12 into the photograph printing section 102. The drive roller 106 is rotated by a driving force of a motor (not shown).

A cutter 112 is disposed in the photograph printing section 102. The cutter 112 comprises a pair of upper and lower blades and is operated by a motor 110. The cutter 112 cuts the photographic paper 12 fed from the paper magazine 104.

A support base 114 is located on a downstream side in a direction in which the photographic paper 12 is fed. The support base 114 is formed so that the upper surface thereof may extend along a horizontal direction (a leftward-and-rightward direction in FIG. 1). A nip roller 120 and a wrapping roller 118 wrapped with an endless belt 116 are located between the support base 114 and the cutter 112 in the horizontal direction (a direction perpendicular to the drawing). The nip roller 120 and the wrapping roller 118 nip the endless belt 116.

A roller group 121 is located on the downstream side of the direction of carriage of the photographic paper 12 with respect to the support base 114. The roller group 121 comprises a plurality of rollers.

Many small holes (not shown) are formed all over the endless belt 116. The endless belt 116 is partially laid on the upper surface of the support base 114. On the upper surface are formed many hole portions (not shown) corresponding to the small holes of the endless belt 116. The support base 114 is formed so that the inner portion thereof may be a cavity. A pair of communicating ducts 122 (one duct alone shown) are formed correspondingly to both the axial ends of the endless belt 116. The communicating ducts 122 are connected to the support base 114. The communicating ducts 122 are connected to a fan box 124.

On the other hand, an easel apparatus 126 is disposed over the endless belt 116 moving on the support base 114.

Figure 2:
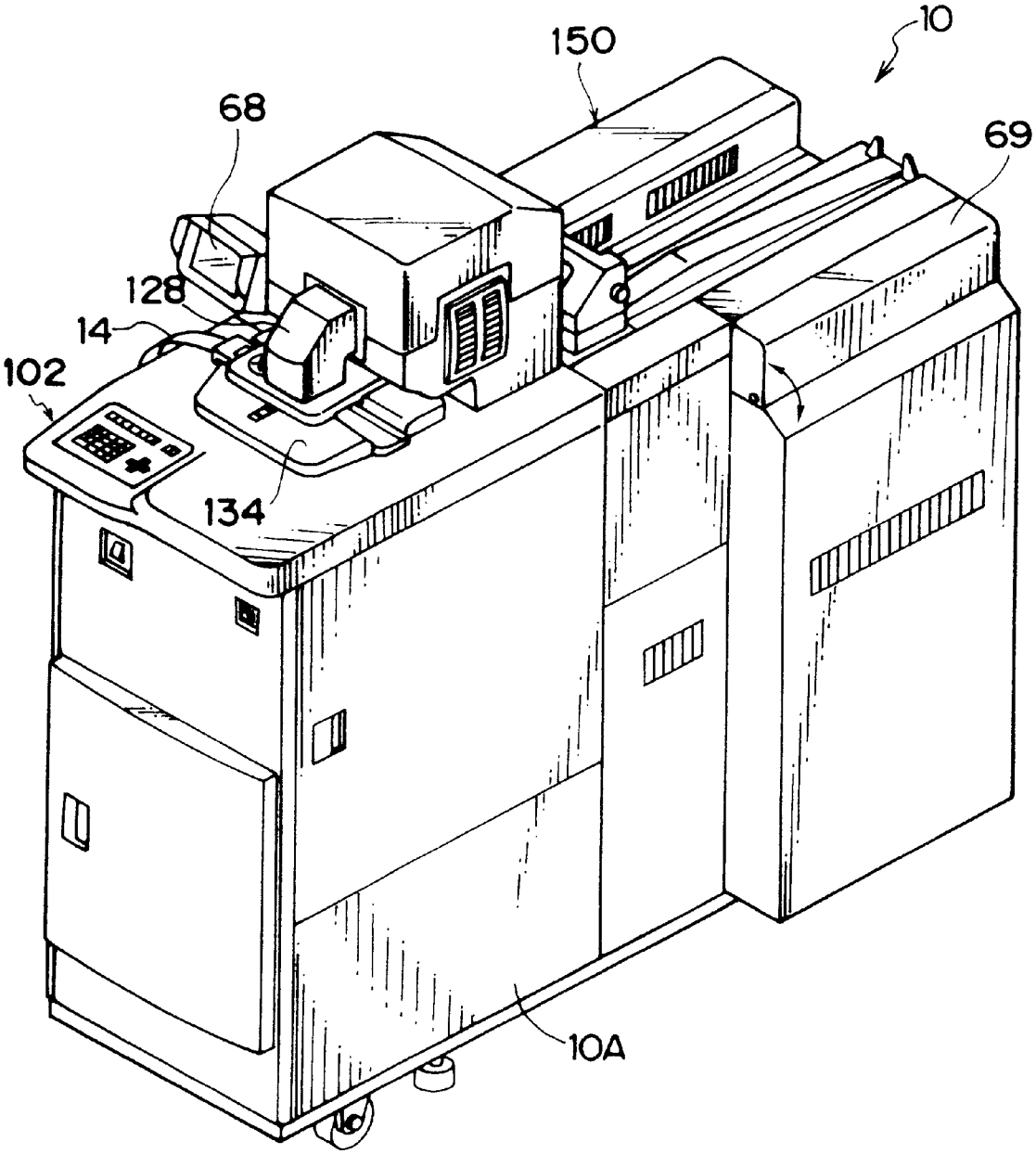
FIG. 2 is a perspective view of the photosensitive material processing apparatus.

As shown in FIGS. 1 and 2, an outer frame of the photosensitive material processing apparatus 10 comprises a casing 10A. A diffusion box 128 for diffusing a light is located outside the casing 10A and directly over the easel apparatus 126. A CC filter 130 is adjacent to the diffusion box 128. The CC filter device 130 comprises movable C, M and Y filters. The device 130 can change an amount of filters to be inserted into a light path. Light is emitted from a light source 132 adjacent to the CC filter 130. The light passes through the CC filter 130. The light is then diffused by the diffusion box 128, while the light ray is deflected and transmitted directly downward.

A negative film 14 is put on a negative carrier 134 which is laid on the upper surface of the casing 10A. The negative film 14 transmits the light.

As shown in FIG. 1, a support plate 138 is supported by a guide rail 136 and disposed in the photograph printing section 102 so that it can be moved in the horizontal direction (the direction perpendicular to the drawing). A prism 142 and a zoom lens 144 are mounted to the support plate 138 so that they may be located on a light axis 140 of the aforementioned light.

Accordingly, the light passes through the negative film 14 so that it is changed to the exposed light. The exposed light passes through the prism 142 and then passes through the zoom lens 144 having a variable magnification. An image of the negative film 14 is formed on the photographic paper 12 located below the easel apparatus 126.

In the photograph printing section 102 is also a density measuring apparatus 146 for measuring a density of the negative film 14. The density measuring apparatus 146 is connected to a controller (not shown). During a printing exposure, an exposure correct value is set based on measured data and data keyed by an operator.

A black shutter 148 is disposed in the light path between the zoom lens 144 and the easel apparatus 126. The black shutter 148 is operated so as to adjust a printing exposure time.

The printing exposure of the image on the photographic paper 12 is completed in the photograph printing section 102 having the above-described structure. The photographic paper 12 is carried by a plurality of rollers of the roller group 121 to a processor section 150 for performing each process such as a development, a bleach, a fixing, a wash and a dry.

In the processor section 150 are disposed a developing tank 152, a bleaching tank 154 and a fixing tank 156, as a processing tank, which reserve a developing solution, a bleaching solution and a fixing solution, respectively. The photographic paper 12 is subsequently dipped in each processing tank so as to perform the process. The photographic paper 12 is also carried to a washing section 158 so as to perform a washing process. The washing section 158 is located adjacent to these processing tanks and comprises a washing tank which reserves washing water.

The washed photographic paper 12 is carried to a dry section 160 located over the washing section 158 so that it is dried by a hot air.

When the above process is completed, the photographic paper 12 is nipped by plural pairs of rollers 162 so that it is discharged from the photosensitive material processing apparatus 10 to the outside. The photographic papers 12 are stacked.

Figure 3:
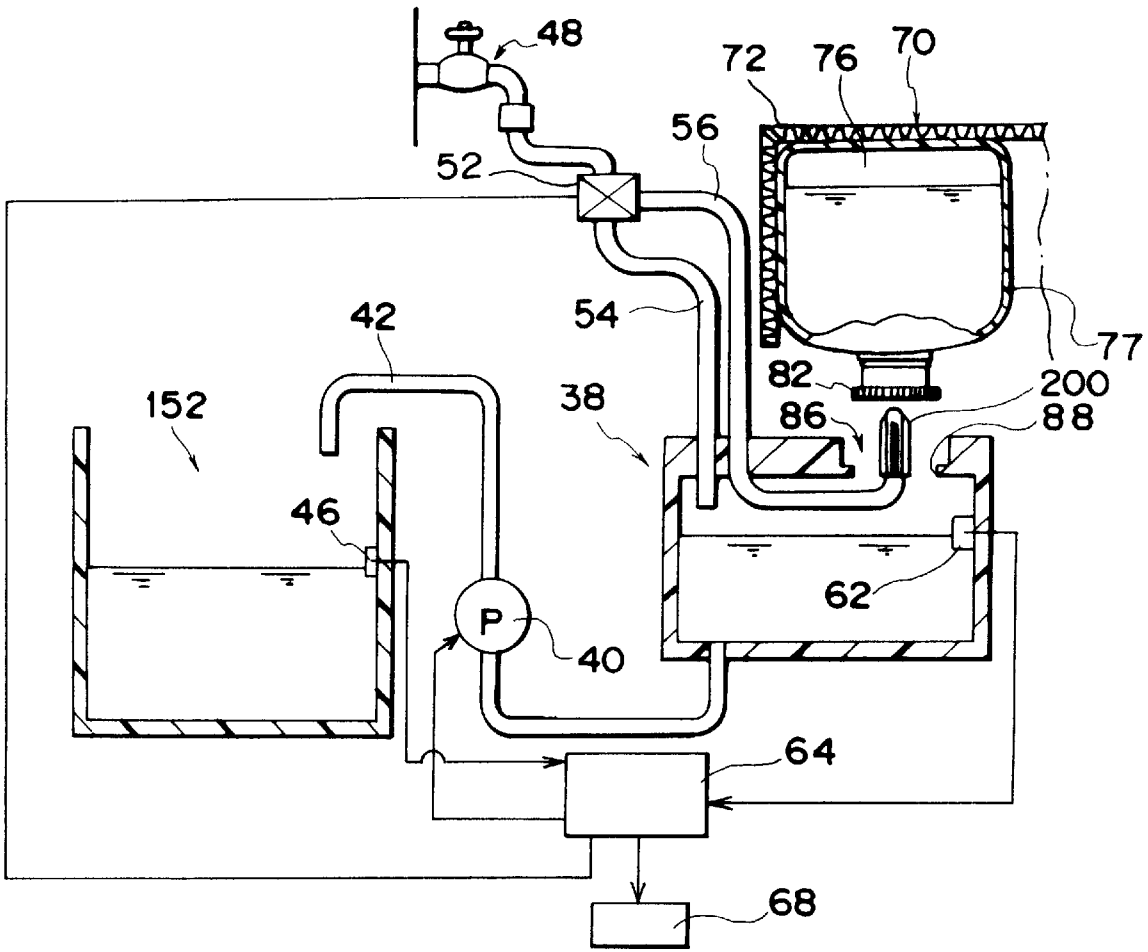
FIG. 3 shows a schematic construction of the processing agent introducing apparatus.

FIG. 3 shows the structure of the processing agent introducing apparatus for replenishing and introducing replenisher or processing solution for replenishment into the processing tank. The replenisher to be replenished in the processing tank is previously reserved in a replenishing tank 38. A pump 40 is operated as needed so that the processing tank can be replenished with the replenisher. In the embodiment, the developing tank 152 alone is shown and described. Since other processing tanks (the bleaching tank 154 and the fixing tank 156) have the same piping structure as the developing tank 152, the description is omitted.

As shown in FIG. 3, one end of a pipe 42 is opened over the developing tank 152. The other end of the pipe 42 is connected to a bottom portion of the replenishing tank 38. The pump 40 is connected to an intermediate portion of the pipe 42. A drive of the pump 40 is controlled by a control section 64. That is, a level sensor 46 is disposed in the developing tank 152 so as to detect a liquid level of the developing solution. When the level sensor 46 recognizes a reduction of the processing solution stored in the developing tank 152 and determines that the replenisher mush be replenished, a signal is input to the control section 64. When this signal is input, the pump 40 is operated so that the developing tank 152 may be replenished with the replenisher from the replenishing tank 38.

The replenishing tank 38 is provided with a level sensor 62 for detecting the liquid level as is the case with the developing tank 152. When the level sensor 62 recognizes the reduction of the replenisher reserved in the replenishing tank 38, a message is displayed on a display section 68 so as to indicate that the replenisher is prepared.

In the embodiment, a system is constructed as described below. When the message is displayed on the display section 68, a lid 69 (see FIG. 2) disposed on the upper portion of the processor section 150 is opened so as to load a processing agent kit 70. The processing agent (concentrated solution) of the processing agent kit 70 is introduced into the replenishing tank 38 as replenisher. A predetermined amount of diluting water is introduced into the replenishing tank. Replenishing solution having a predetermined concentration is produced in the replenishing tank 38.

In the embodiment, tap water is used as the diluting water. As shown in FIG. 3, a tap 48 of a water supply is connected to one end of a piping 50. An electromagnetically switchable switch valve 52 is connected to the other end of the piping 50. The water supply may be replaced by the tank for reservoiring the diluting water so that the diluting water reservoired in the tank may be supplied to the tank 38.

The switch valve 52 is connected to one end of a piping 54 and one end of a piping 56. The switch valve 52 is switched to three conditions. That is, a first condition is that the tap water is allowed to pass through the piping 54 so as to supply the tap water directly to the replenishing tank 38. A second condition is that the tap water is allowed to pass through the piping 56. A third condition is that the supply of the tap water is stopped.

Three bottles 76 are accommodated in the processing agent kit 70 (one bottle alone shown in FIG. 3). The processing agents are sealed in the bottles 76 correspondingly to the developing tank 152, the bleaching tank 154 and the fixing tank 156, respectively. These three bottles 76 are covered with a casing 72 which is made of a corrugated board or the like.

Figure 4A:
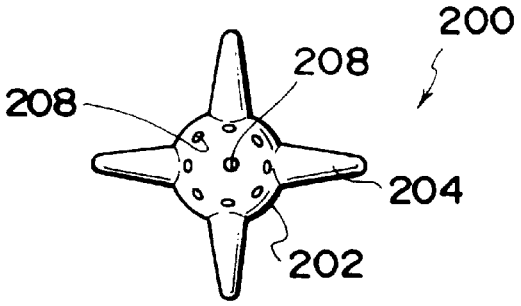
FIG. 4A is a plan view of an unsealing member according to the first embodiment seen from the end side thereof.
Figure 4B:
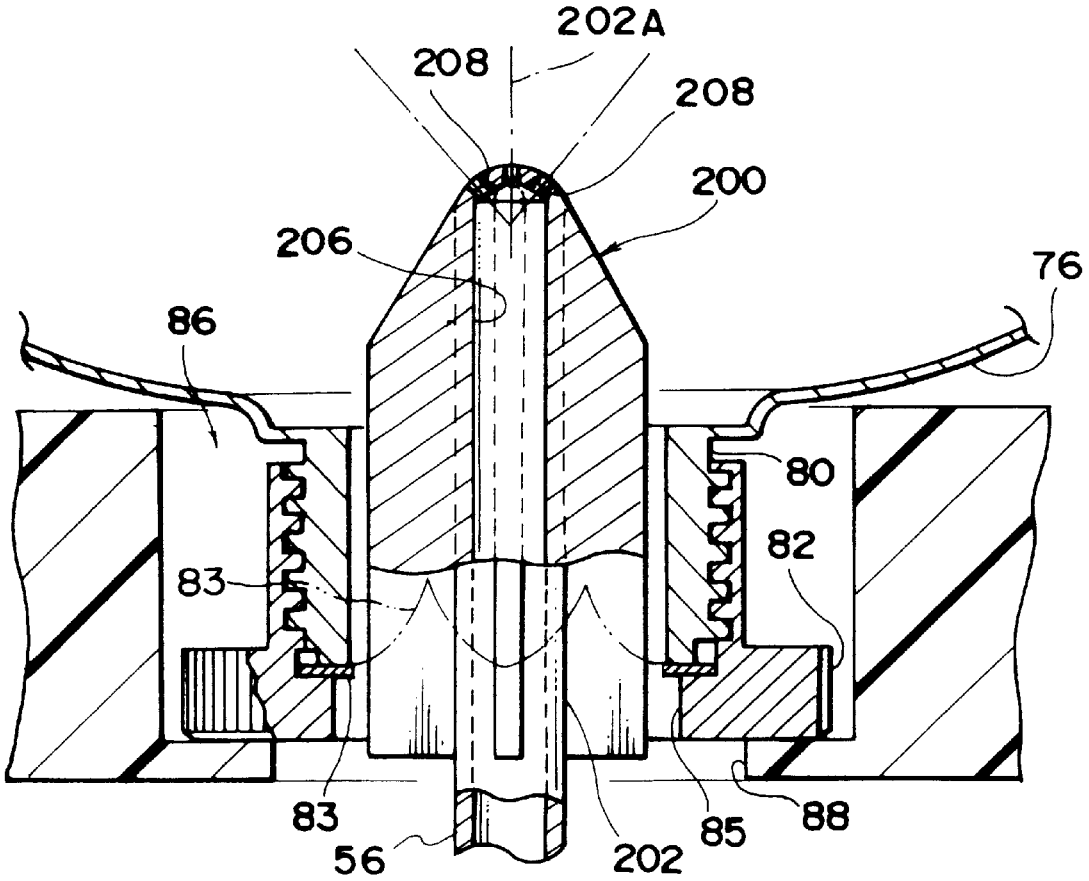
FIG. 4B is a cross-sectional view of the unsealing member according to the first embodiment in a condition that a bottle is unsealed.

As shown FIGS. 3 and 4B, a pour spout 80 of the bottle 76 of the processing agent kit 70 has an outer diameter which is smaller than the outer diameter of a body 77 of the bottle 76 filled with the processing agent for replenishment. The body 77 and the pour spout 80 of the bottle 76 are cylindrical in shape. The pour spout 80 is coaxially disposed with respect to the bottle 76.

The pour spout 80 is sealed by a cap 82 and a thin-wall seal 83 so as not to leak the processing agent (the broken seal 83 is shown in FIG. 4B). A circular hole 85 is also formed at the center of the cap 82.

As shown in FIG. 3, a concave bottle support section 86 for supporting the bottom-up bottle 76 is disposed over the replenishing tank 38. A hole 88 is formed in the bottle support section 86. The other end of the piping 56 is located upward at the center of the hole 88. An unsealing member 200 is mounted to the other end of the piping 56. When the bottle 76 is loaded with the pour spout 80 oriented downward, the seal 83 sealing the pour spout 80 is pressed and broken by the unsealing member 200. This opens the bottle 76.

As shown in FIG. 4, the unsealing member 200 of the embodiment has a cylindrical section 202 which is vertically disposed and is round in shape. Four tapered winglets 204 are disposed on an outer circumference surface of the cylindrical section 202 so that they may axially look like a cross in shape.

A passage 206 is formed from a lower end to an upper end in a central portion of the cylindrical section 202. A plurality of openings 208 are formed near the upper end of the cylindrical section 202. Each opening 208 has a diameter less than the diameter of the passage 206.

One of the plural openings 208 is coaxially formed with respect to a center axis 202A of the cylindrical section 202. The other openings 208 are constantly spaced along a circumferential direction of the cylindrical section 202 near the one opening 208 which is coaxially formed with respect to the center axis 202A. The orientation of the openings 208 is inclined at, for example, 45° to the center axis on the upper end side of the cylindrical section 202.

When the processing agent kit 70 is loaded, the amount of progress of the unsealing member 200 is determined so that the upper end of the unsealing member 200 having the opening 208 may progress into the body 77 of the bottle 76.

An operation of the embodiment will be described below.

When a predetermined exposure is completed, the photographic paper 12 is subsequently dipped in each processing tank such as the developing tank 152, the bleaching tank 154, the fixing tank 156 and the washing section 158 comprising a plurality of washing tanks. The photographic paper 12 is then dried by the dry section 160.

Moisture or water in the processing solutions contained in the developing tank 152, the bleaching tank 154 and the fixing tank 156 is adhered to the photosensitive material and carried out of the processing tank together with the photosensitive material. The moisture is also evaporated as a time passes. Furthermore, the evaporation causes the concentration of the processing solution. Therefore, when the processing solution contained in each processing tank is reduced, the processing tank is replenished with the replenishing solution for supplementing this reduction.

When the level sensor 46 detects the reduction of the processing solution in the processing tank, the pump 40 is operated so that the processing tank may be replenished with the replenishing solution from the replenishing tank 38.

When the reduction of the replenisher is detected by the sensor 62 mounted to the replenishing tank 38, the message is displayed on the display section 68 so as to instruct the supply of the replenishing solution.

When the replenishing solution is reduced, the lid 69 is opened so as to load the bottle 76 of the processing agent kit 70 in the bottle support section 86. A load operation of the bottle 76 allows the unsealing member 200 to press and break the seal 83. The processing agent flows into the replenishing tank 38.

After a predetermined time passes since the flow of the processing agent into the replenishing tank 38, the switch valve 52 is switched. A predetermined amount of tap water is jetted from the openings 208 of the unsealing member 200.

In the embodiment, the plurality of openings 208 jet the tap water in different directions such as an upward direction and an oblique upward direction. Thus, the water can be more widely and uniformly jetted than cleaning solution or water jetted from one opening. The tap water is shot on an inner wall surface of the bottle 76 and is splashed. The splashed water partially drops down along the side wall of the bottle, thereby cleaning the side wall. The cleaning is performed around the pour spout 80 by the dropping cleaning solution.

That is, the apparatus according to the embodiment can jet the cleaning solution or water over a greater range than the apparatus jetting the cleaning solution toward one point. The bottle 76 can be cleaned by a small amount of tap water. Angles of the openings 208 are changed in accordance with the shape of the bottle 76 so that the tap water can be jetted in an appropriate direction. Thus, the cleaning can be efficiently performed.

After the cleaning of the bottle, the switch valve 52 is switched so as to supply the tap water to the replenishing tank 38 through the piping 54. The replenishing solution having a predetermined concentration is prepared in the replenishing tank 38.

Embodiment 2

A second embodiment of the present invention will be described with reference to FIGS. 5A and 5B.

Figure 5A:
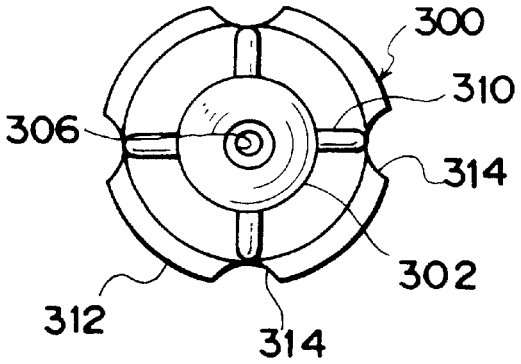
FIG. 5A is a plan view of the unsealing member according to a second embodiment seen from the end side thereof.
Figure 5B:
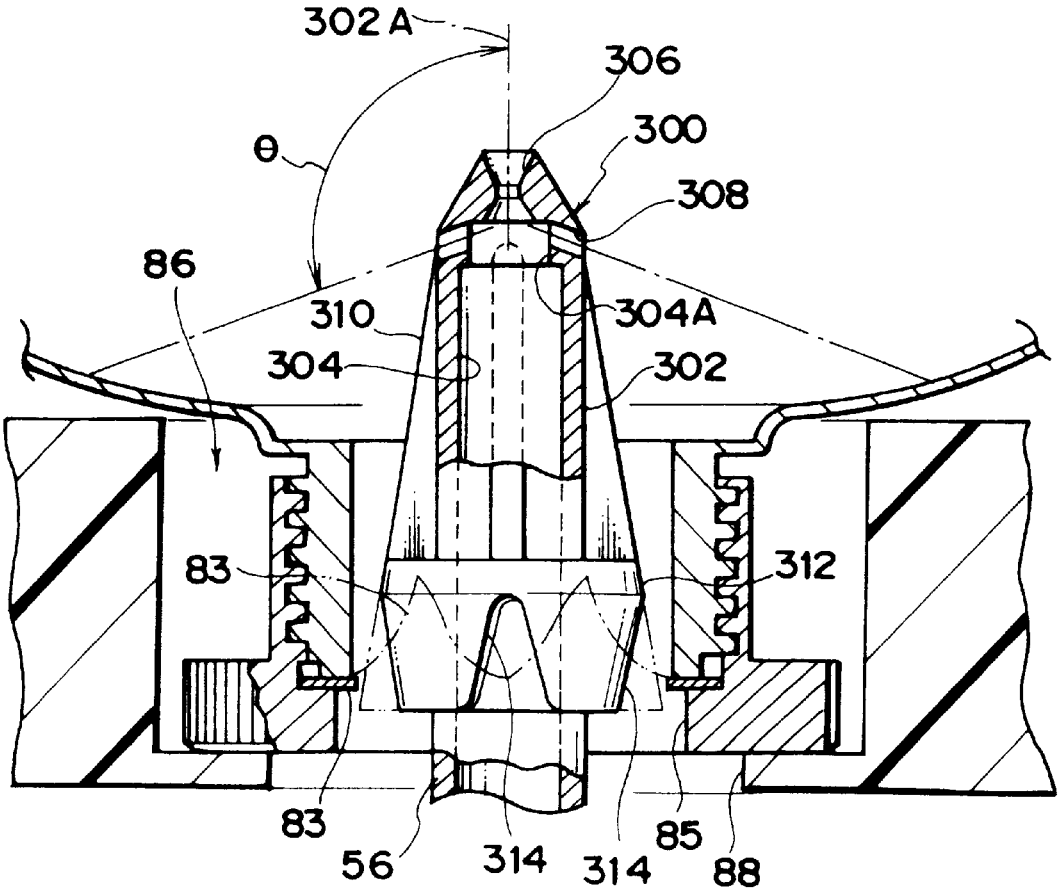
FIG. 5B is a cross-sectional view of the unsealing member according to the second embodiment in a condition that the bottle is unsealed.

As shown in FIGS. 5A and 5B, a passage 304 is formed along the center axis of a cylindrical section 302 of an unsealing member 300 of the embodiment so that the passage 304 may extend from a base portion to the upper end. The upper end portion of the passage 304 is formed with a small diameter section 304A. Near the upper end of the cylindrical section 302 are formed openings 306 and 308 whose diameters are less than the diameter of the passage 304.

The opening 306 is coaxially formed with respect to a center axis 302A of the cylindrical section 302. The tap water is jetted along the center axis of the cylindrical section 302. The opening 306 is tapered toward the egress side thereof so that the diameter may be increased. This allows the tap water to be jetted widely to some extent.

On the other hand, the plurality of openings 308 are constantly spaced along the circumferential direction of the axis section 302 near the opening 306. The angle of each opening 308 (a tap water jetting angle: θ shown in FIG. 5B) is 90° or more in relation to the center axis on the upper end side of the cylindrical section 302.

Four tapered winglets 310 are disposed on the outer circumference surface of the cylindrical section 302 so that they may axially look like the cross in shape. An annular section 312 is disposed on the base portion of the cylindrical section 302 so that it may be a truncated cone in shape. In the annular section 312 are formed a plurality of notches 314 extending along an axial direction in which the processing agent flows.

The unsealing member 300 is inserted into the body 77 of the bottle 76 up to a predetermined distance and the ring section 312 may press and expand the seal 83 thereby allowing the notches 314 to progress into the pour spout 80.

In the embodiment, the tap water jetted from the opening 306 is spread to some extent and is directly shot on the bottom portion of the bottle 76 so as to clean the bottom portion. The splashed water partially drops down along an inner circumference surface of the body 77 so as to clean the inner circumference surface.

On the other hand, the tap water jetted from the openings 308 is directly shot around the periphery of the pour spout 80 of the body 77 so as to clean the periphery of the pour spout 80.

The tap water dropping along the inner circumference surface of the body 77 collides with the tap water jetted from an opening 210, thereby causing a turbulent flow. Thus, a cleaning effect around the periphery of the pour spout 80 is further increased.

Since the notches 314 are disposed in the unsealing member 300, flow properties of the processing agent and the tap water are excellent.

Embodiment 3

A third embodiment will be described with reference to FIG. 6. The third embodiment is a variation of the second embodiment described above. The same components of the third embodiment as those of the second embodiment have the same reference numbers. The description is omitted.

Figure 6:
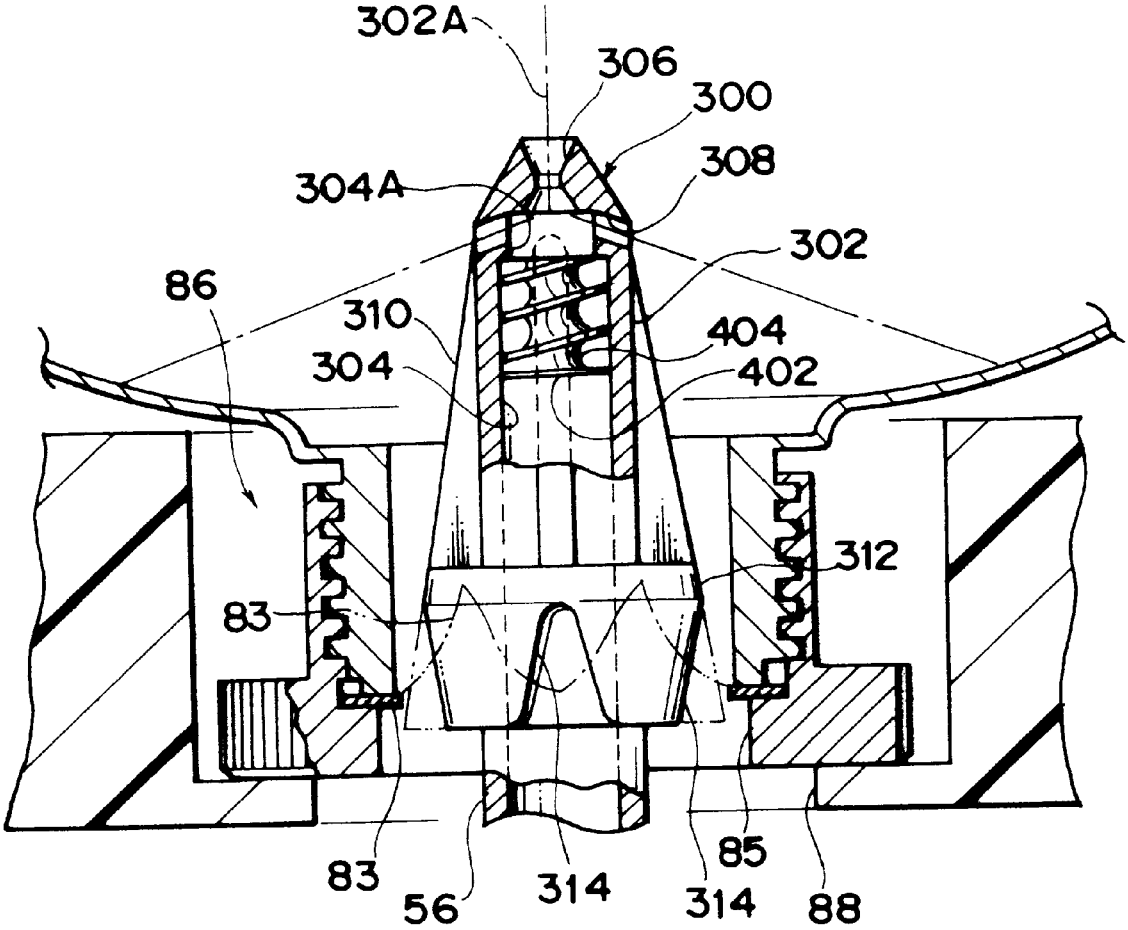
FIG. 6 is a cross-sectional view of the unsealing member according to a third embodiment in a condition that the bottle is unsealed.

As shown in FIG. 6, a whirler or whirling member 402 is inserted in the passage 304 of the unsealing member 300. The whirler 402 is in contact with of a step portion of the small diameter section 304A of the passage 304. A space portion is formed in the small diameter section 304A.

A single-thread helical groove 404 is formed in the whirler 402. The tap water passes through the helical groove 404 so that the turbulent flow occurs in the space portion of the small diameter section 304A. The tap water is jetted from the openings 306 and 308 so that it may be spread in a mist state and in a cone shape.

The opening 306 of the embodiment has a diameter of 1.5 mm and a taper angle of 90°. The opening 308 has a diameter of 1.2 mm. The openings 308 are disposed in three positions in the circumferential direction.

Thus, compared to the aforementioned second embodiment, the range which the tap water is directly shot on is spread. Accordingly, the cleaning effect is increased.

When the diameter of the opening 306 is reduced, a sprayed droplet becomes small. When the taper angle is increased on the egress side of the opening 306, the droplet is sprayed over the greater range. The diameter and the taper angle may be appropriately changed in accordance with the shape of the bottle 76 and physical properties of the processing agent.

When a hole diameter is too large and too many openings are disposed, a water pressure is reduced. Thus, spray properties are deteriorated, and the diameter of the droplet is increased. Therefore, the water cannot be uniformly sprayed. However, since the increase of the pressure improves this problem, the hole diameter of the openings 306, 308 and the number of holes are not limited to the aforementioned diameter and number.

Figure 7:
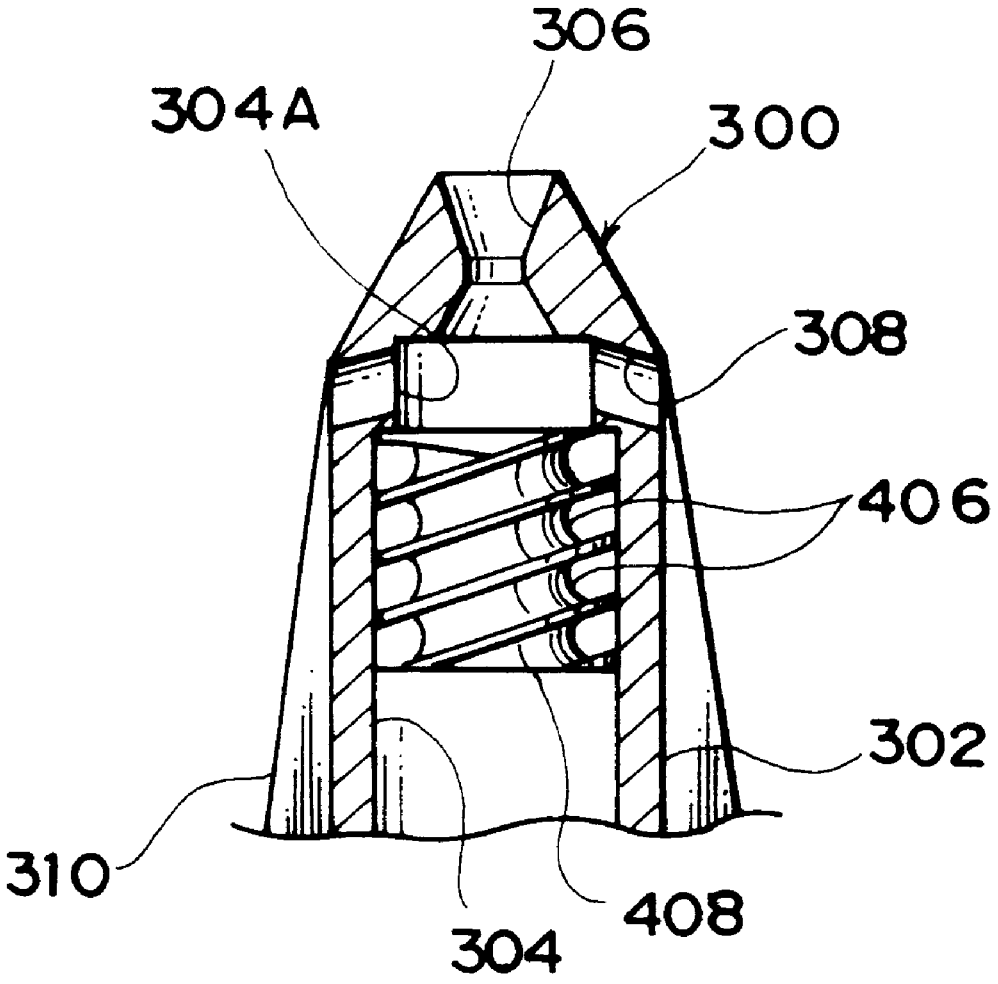
FIG. 7 is a cross-sectional view of a proximity of the end of the unsealing member according to a variation of the third embodiment.
Figure 8A:
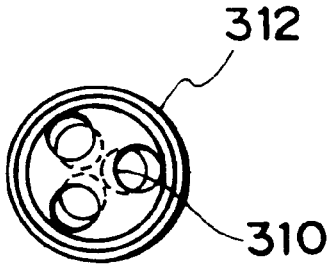
FIG. 8A is a plan view of a whirler of the unsealing member according to another variation of the third embodiment seen from the end side thereof.
Figure 8B:
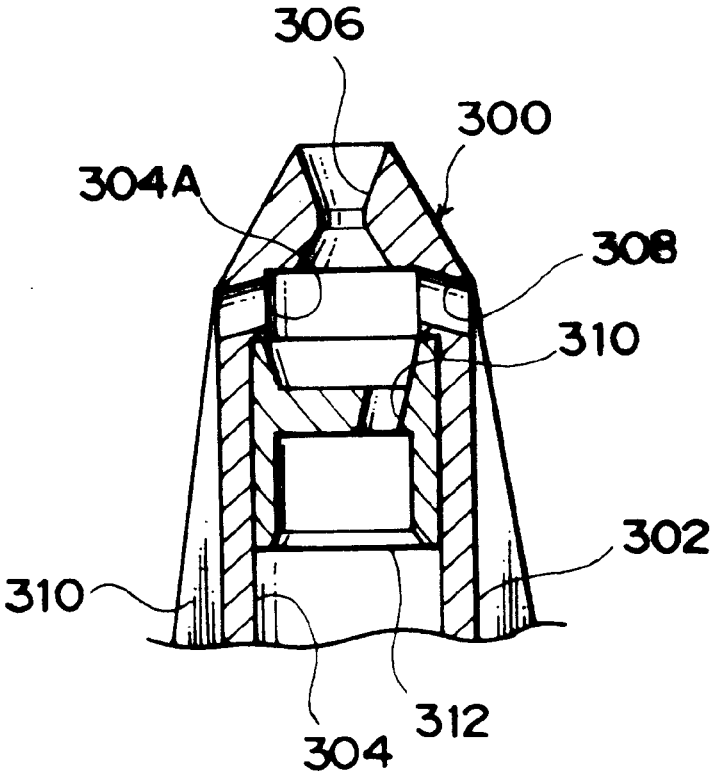
FIG. 8B is a cross-sectional view of the proximity of the end of the unsealing member according to a variation of FIG. 8A.

In the embodiment, the whirler 402 having the single-thread helical groove 404 is used in order to perform the spray. On the other hand, for example, as shown in FIG. 7, a whirler 408 having a two-thread helical groove 406 may be used. As shown in FIGS. 8A and 8B, a whirler 312 may be used, where the whirler 312 has a plurality of small holes 310 which are inclined in a direction spaced from the center axis on the egress side. The whirler may be used in other shape, as long as the whirler can generate an appropriate turbulent flow and a centrifugal force for the tap water (cleaning solution).

Although the unsealing members 200 and 300 are vertically disposed in the embodiments described above, they may be inclined.

Although the bottle 76 is vertically held in a bottom-up state in the embodiments described above, it may be held in an inclined state.

A progressively moving distance of the unsealing members 200 and 300 into the bottle 76, a jetting direction of the cleaning tap water or the like is appropriately changed depending on the shape and orientation of the bottle 76, a kind of the processing agent or the like. They are not limited to the aforementioned embodiments.

Embodiment 4

Figure 9:
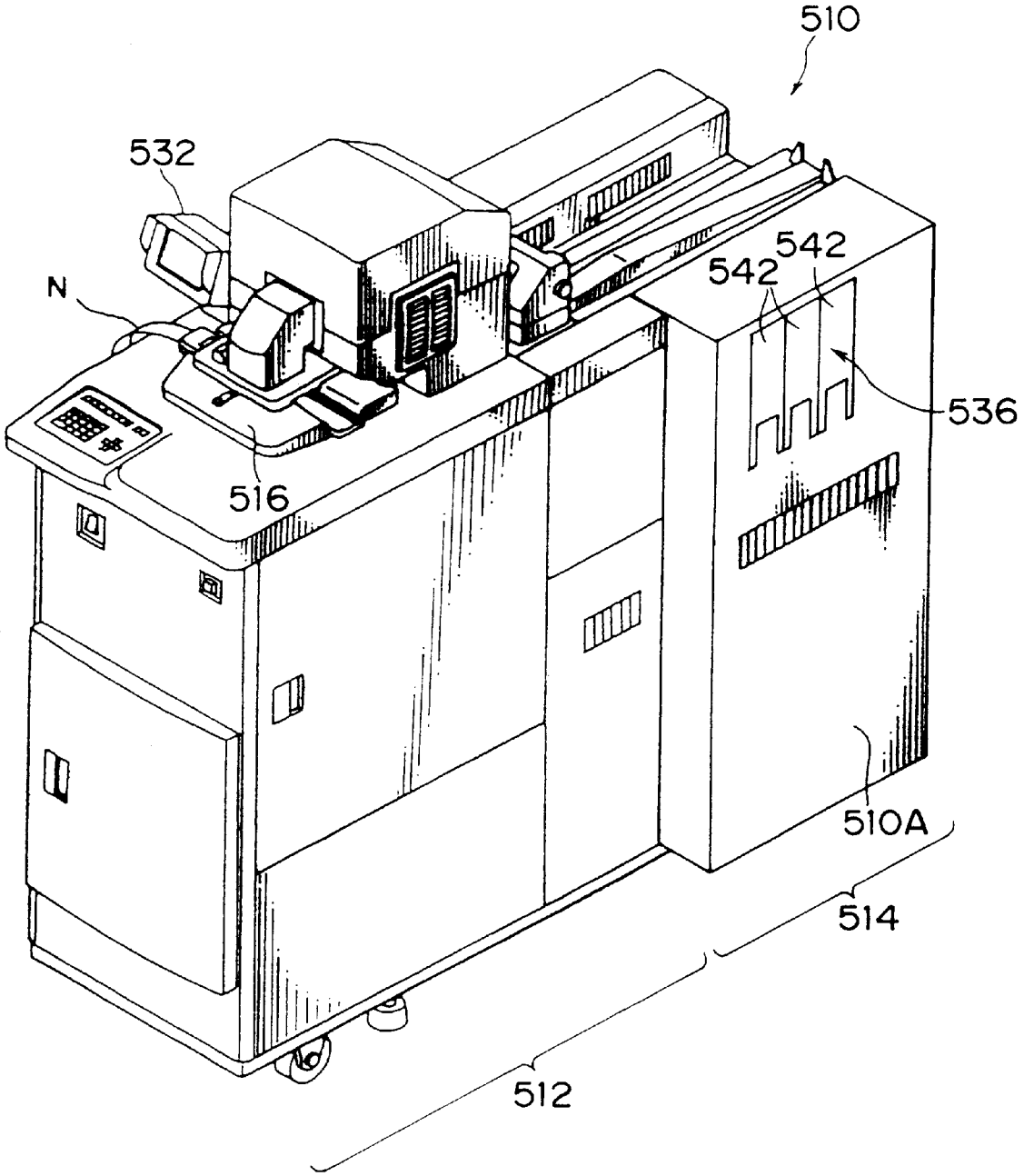
FIG. 9 is a perspective view of a printer processor adopting a fourth embodiment of the present invention.

FIG. 9 is a perspective view of a printer processor 510 used as the photosensitive material processing apparatus. The printer processor 510 is provided with a printer section 512 and a processor section 514.

The printer section 512 is operated so as to expose the image of a negative film N set in a negative carrier 516 on a photographic paper P (not shown) and to carry the photographic paper P to the processor section 514.

The processor section 514 includes the developing tank, the bleaching/fixing tank, the washing tank as processing tanks and the drying section (not shown in FIG. 9). In the processor section 514, the photographic paper P carried from the printer section 512 is developed.

Figure 10:
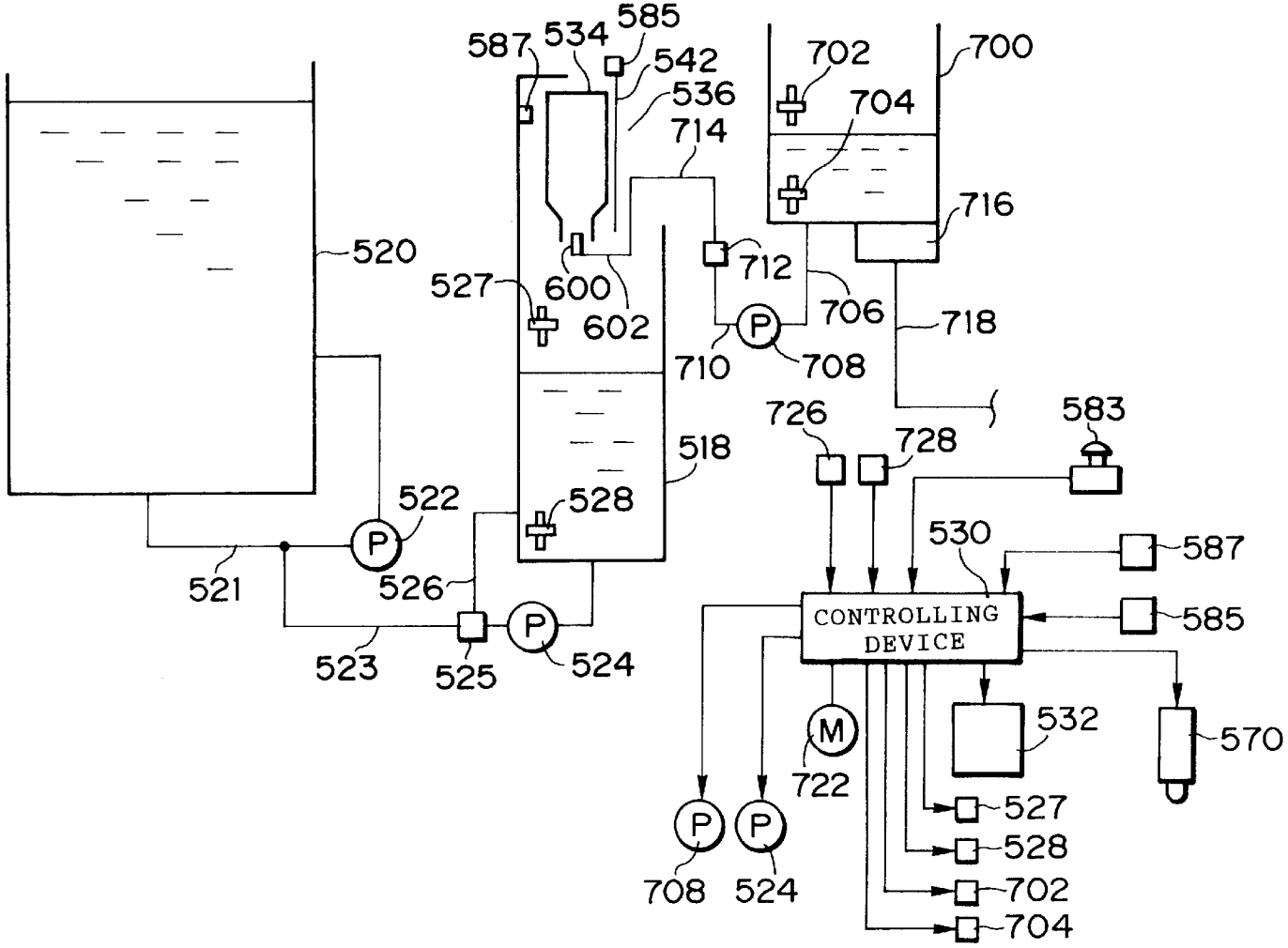
FIG. 10 is a piping diagram of a periphery of a developing tank, a refilling tank and a water tank.

As shown in FIG. 10, a development replenishing solution, a bleach/fix replenishing solution and a stabilization replenishing solution as a replenishing agent are sent from replenishing tanks 518 (one tank alone shown in FIG. 10), each comprising a reservoir installed in the processor section 514 to the developing tank, the bleaching/fixing tank and the washing tank, respectively.

Next, the structure for replenishing the solution will be described as an example of a developing tank 520 in each processing tank with reference to FIG. 10.

The developing solution in the developing tank 520 is circulated by a piping 521 and a circulating pump 522. The circulating pump 522 is controlled by a controlling device 530.

The piping 521 is coupled to the bottom portion of the replenishing tank 518 through a piping 523. A replenishing pump 524 and a three-way valve 525 controlled by the controlling device 530 are disposed in the course of the piping 523.

One end of the piping 526 is connected to the three-way valve 525. The other end of the piping 526 is coupled to the side wall of the replenishing tank 518. The three-way valve 525 can switch from one condition for circulating the replenishing solution in the replenishing tank 518 to another condition for sending the replenishing solution to the developing tank 520.

The replenishing tank 518 is provided with an upper limit detecting switch or sensor 527 and a lower limit detecting switch or sensor 528 connected to the controlling device 530. The controlling device 530 can determine whether or not the level of the replenishing solution reaches the upper limit or the lower limit of the replenishing tank 518. The upper limit detecting switch 527 and lower limit detecting switch 528 correspond to processing agent level detecting means of the present invention.

Figure 11:
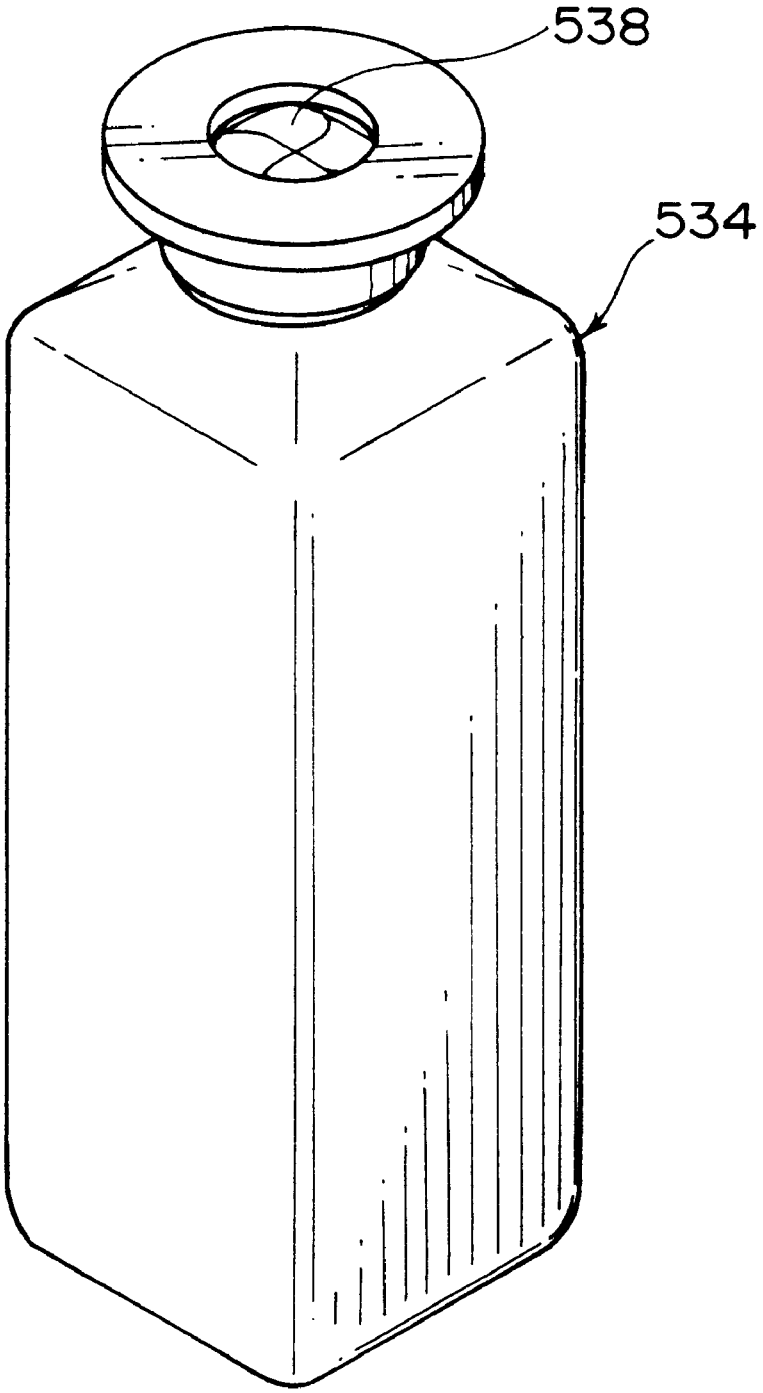
FIG. 11 is a perspective view of a processing agent container.

The embodiment is constructed as the system described below. That is, when the replenishing solution in the replenishing tank 518 is lacking, a processing agent container 534 shown in FIG. 11 is set in a replenishing section 536 (see FIG. 9) installed on the upper side of a casing 510A so as to pour replenisher.

Processing agent container

The structure of the processing agent container 534 will be described with reference to FIGS. 11 and 12.

Figure 12A:
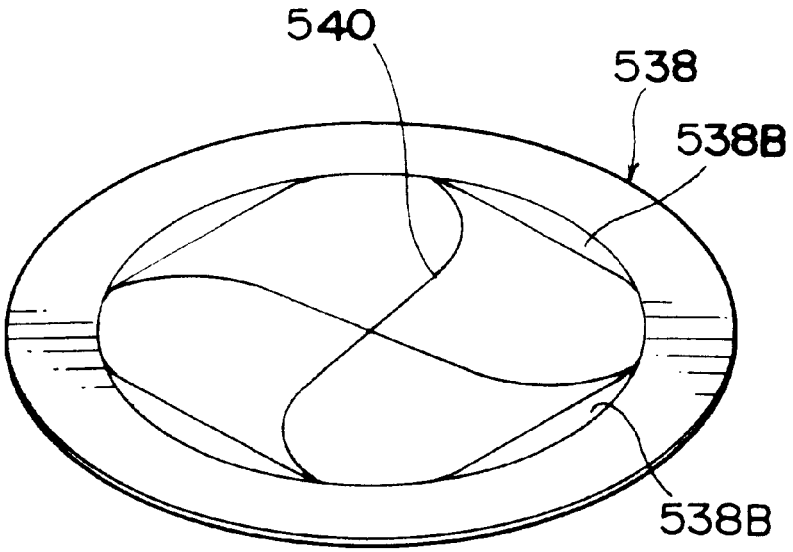
FIG. 12A is a perspective view of a cap of the processing agent container prior to a break.

The processing agent container 534 is made of a synthetic resin. The opening of the processing agent container 534 is closed by a synthetic resin cap 538 as shown in FIG. 12A.

The cap 538 is made of an elastic material (the synthetic resin, a rubber or the like). As shown in FIG. 12A, a generally cross (卍) shaped groove 540 is formed at the center portion.

Figure 12B:
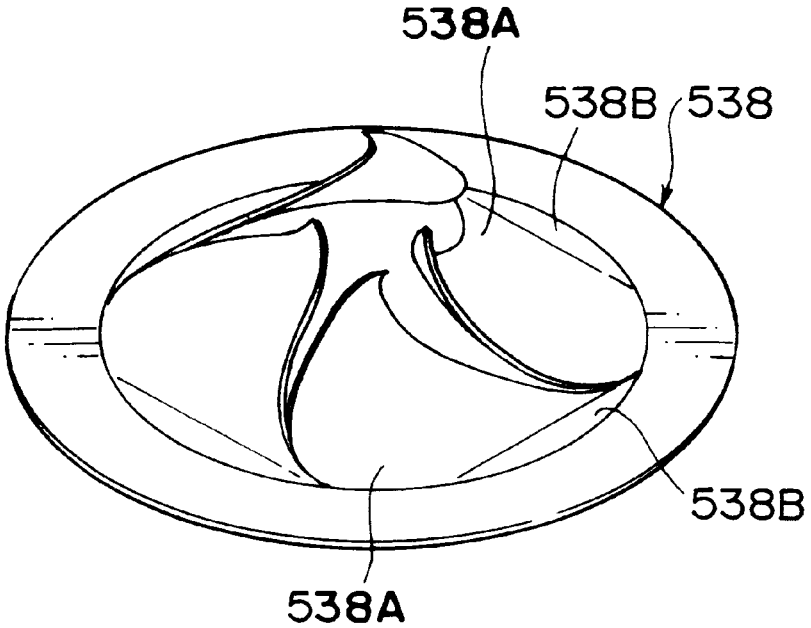
FIG. 12B is a perspective view of the cap of the processing agent container after the break.

When the center portion of the cap 538 is pressed inward by a protruding object, the cap 538 is broken along the groove 540 as shown in FIG. 12B. Four breaking pieces 538A are turned up toward the inside of the container. A generally crescent thin-wall portion 538B is disposed on the base portion of the breaking piece 538A so that the breaking piece 538A may be easy to turn up.

Replenishing section

As shown in FIG. 9, the replenishing section 536 is disposed on the upper side of the casing 510A. The aforementioned refilling tank 518 is located directly below the replenishing section 536.

Figure 13:
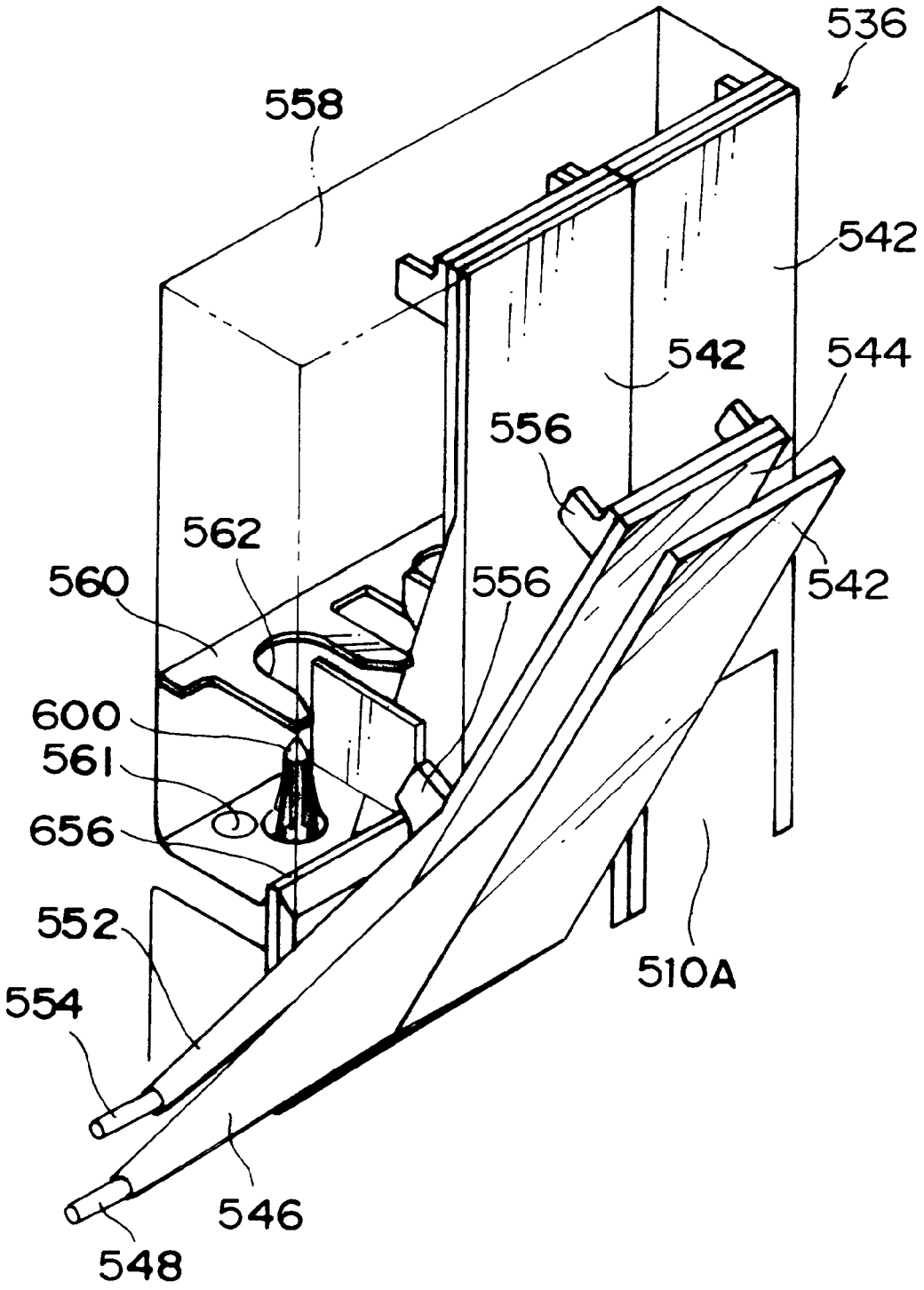
FIG. 13 is a perspective view of a refilling section.

As shown in FIG. 13, the replenishing section 536 is provided with an outer cover 542 and an inner cover 544 as container loading means. These covers can be opened and closed.

An arm 546 is integrally mounted to the outer cover 542. A shaft 548 is fixed to the end of the arm 546. The shaft 548 is ratably inserted into a bearing hole (not shown) of the casing 510A.

The outer cover 542 and the inner cover 544 are urged by a spring (not shown) so that the cover can be smoothly opened and closed.

Figure 14:
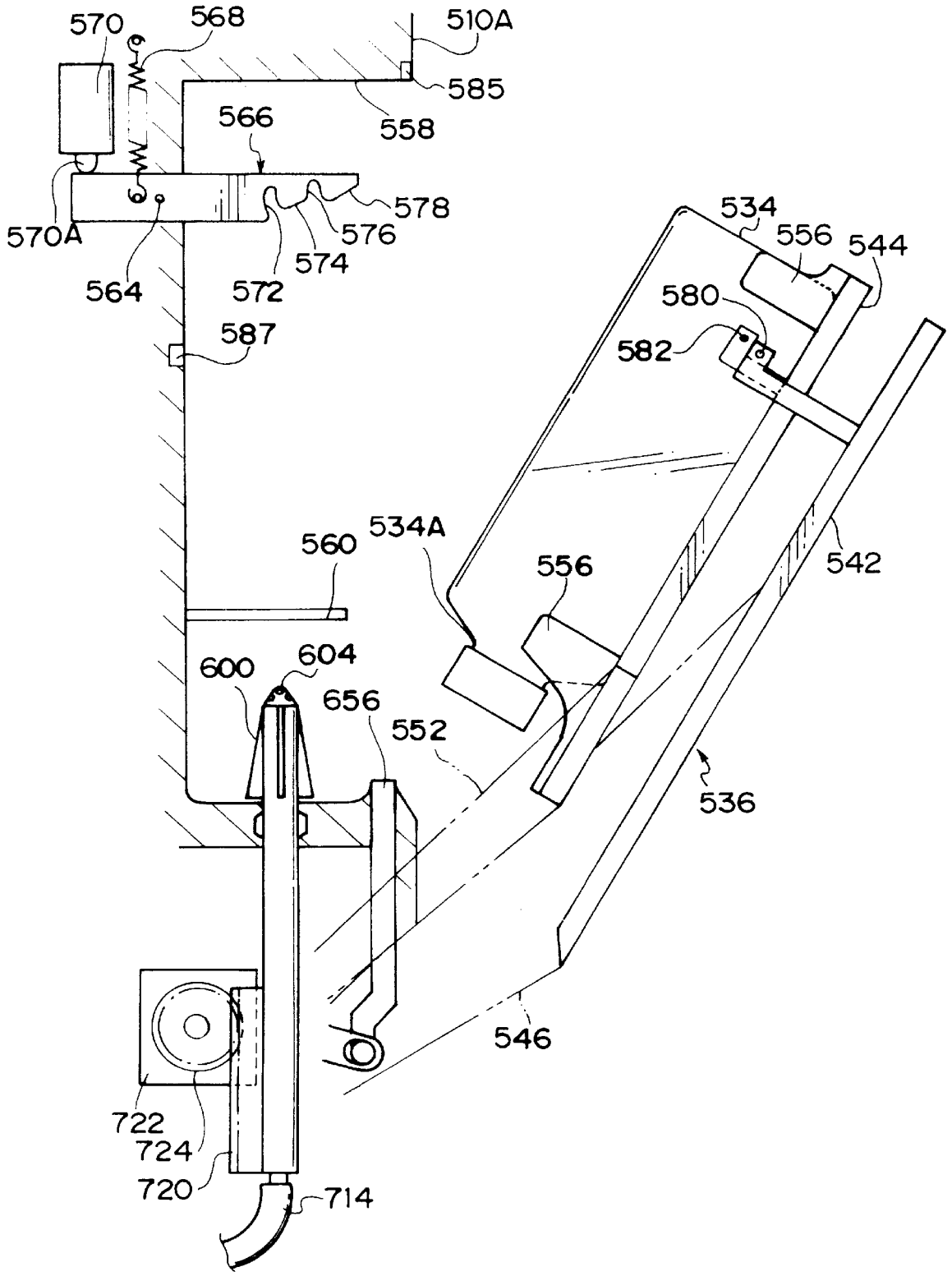
FIG. 14 is a cross-sectional view of the refilling section whose outer cover is opened.

As shown in FIGS. 13 and 14, in the inner cover 544 is mounted a holder 556 used as a holding section for holding the processing agent container 534 in the bottom-up state.

The casing 510A is provided with a concavity 558 for accommodating the processing agent container 534. A holding plate 560 is mounted on the side wall of the concavity 558. On the holding plate 560 is formed notches 562 which a neck portions 534A of the processing agent containers 534 are inserted into. On the bottom surface of the concavity 558 are formed holes 561 for guiding processing agents or replenishers flowed from the processing agent containers 534 to the replenishing tanks 518.

As shown in FIG. 14, the casing 510A has a lever 566 which can be pivoted about a pin 564.

The lever 566 is urged by an extension spring 568 in a clockwise direction in FIG. 14. The upper surface of the lever 566 is in contact with the end of a movable iron core 570A of a solenoid 570 on one end side.

On the lower surface of the lever 566 are formed a recess 572, a slant portion 574, a recess 576 and a slant portion 578 on the other end side.

Figure 15:
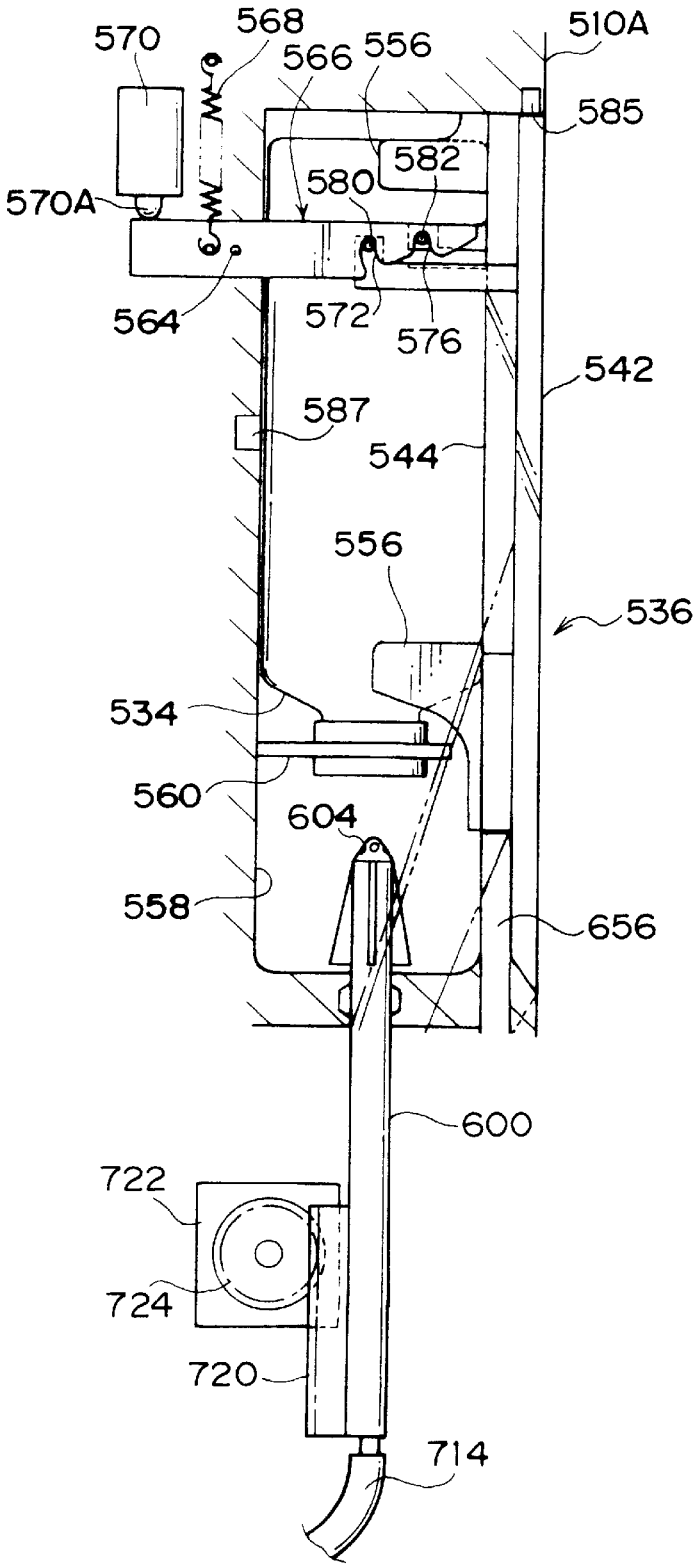
FIG. 15 is a cross-sectional view of the refilling section whose outer cover is closed.

The lever 566 is usually in a horizontal state as shown in FIG. 14. As the outer cover 542 and the inner cover 544 are closed, a pin 580 of the outer cover 542 slides on the slant portion 574. A pin 582 of the inner cover 544 slides on the slant portion 578 thereby rotating the lever 566 counterclockwise. As shown in FIG. 15, when the outer cover 542 and the inner cover 544 are completely closed, the pin 580 of the outer cover 542 is engaged with edge of the recess 572. The pin 582 of the inner cover 544 is engaged with the edge of the recess 576.

The solenoid 570 is connected to the controlling device 530 (see FIG. 10). When an unlocking button 583 connected to the controlling device 530 is pressed, the controlling device 530 makes the solenoid 570 energized. When the solenoid 570 becomes actuated, the movable iron core 570A is extruded so as to rotate the lever 566 counterclockwise. Thus, the pins 580 and 582 are disengaged from the edges of the recesses 572 and 576. The outer cover 542 and the inner cover 544 are then unlocked.

As shown in FIGS. 10 and 14, to the casing 510A are mounted a switch 585 connected to the controlling device 530 for detecting the open/close of the outer cover 542 and a switch 587 used as container detecting means for detecting the existence of the processing agent container 534.

The concavity 558 is provided with an unsealing member 600. The unsealing member 600 is supported so that it can be moved upward and downward alone with respect to the casing 510A. The passage is formed in the unsealing member 600. A hose 714 is coupled to one end of the passage.

When the diluting water is sent to the unsealing member 600 through the hose 714, the diluting water is jetted from a plurality of cleaning solution jetting holes 604 formed at the end of the unsealing member 600.

As shown in FIG. 10, a water tank 700 is disposed in the casing 510A. The water tank 700 has an upper limit detecting switch 702 and a lower limit detecting switch 704 connected to the controlling device 530. The controlling device 530 can determine whether or not the level of cleaning or diluting water reaches the upper limit or the lower limit of the water tank 700. The upper limit detecting switch 702 and lower limit detecting switch 704 correspond to cleaning water level detecting means of the embodiment. The switches may be replaced by the sensor which can continuously detect the level.

To the bottom portion of the water tank 700 are subsequently connected a pipe 706, a pump 708, a pipe 710, an electromagnetic valve 712 and a flexible hose 714.

The pump 708 is connected to the controlling device 530. Thus, the controlling device 530 grasps the amount of diluting water to be sent to the replenishing tank 518 based on the amount of rotation of a rotating axis of the pump 708 which can be detected from an AC motor rotating time.

To the bottom portion of the water tank 700 is connected a piping 718 which sends the cleaning water to another system through an ion exchange water refining resin filter 716.

As shown in FIG. 14, the passage is formed in the unsealing member 600. The aforementioned hose 714 is coupled to one end of the passage.

A rack 720 is mounted to the unsealing member 600. A pinion gear 724 rotated by a motor 722 controlled by the controlling device 530 is meshed with the rack 720. The pinion gear 724 is rotated and the unsealing member 600 is moved upward, thereby allowing the unsealing member 600 to press and break the cap or sealing member 538. The rack 720, the motor 722 and the pinion gear 724 correspond to diving means of the embodiment.

The controlling device 530 is connected to a monitor 532 (also shown in FIG. 9) which is a display apparatus. The monitor 532 can display the message indicating the supply of the replenisher to the replenishing tank 518 and the supply of the cleaning water to the water tank 700.

The controlling device 530 is connected to a temperature sensor 726 and a humidity sensor 728 as environment detecting means for measuring a temperature and a humidity of an environment (including an atmosphere of the replenishing section 536) which the printer processor 510 is installed in. The connected equipment in the printer processor 510 can be controlled depending on the temperature and the humidity of the environment.

Next, a seal mechanism 625 will be described with reference to FIGS. 13 and 16. A seal plate 656 is supported in the casing 510A so that it can be moved only upward and downward.

A fan gear 626 is fastened to the shaft 548 of the outer cover 542. A small gear or pinion 628 of a Geneva device is meshed with the fan gear 626.

One end of a shaft arm 630 and a fan cam 632 are fastened to the small gear 628. A small roller 634 is rotatablly mounted to the other end of the shaft arm 630.

A driven member 642 is located above the small gear 628. The driven member 642 has a groove 636 which the small roller 634 is moved in and out and arc curved surfaces 638, 640 which the outer circumferential surface of the fan cam 632 slides on.

A shaft 644 is fastened to the driven member 642. The shaft 644 is inserted into the bearing hole (not shown) of the casing 510A so that it can be rotated.

A small gear or pinion 646 is fastened to the shaft 644. A small gear 648 is mated with the small gear 646. A large gear 650 is mated with the small gear 648.

One end of a link 652 is fastened to the large gear 650. A long hole 654 is formed on the other end of the link 652. A pin 658 fastened to the lower end of the seal plate 656 is inserted into the long hole 654.

Next, an operation of the embodiment will be described.

For example, when the photographic paper P is developed in the developing tank 520, the replenishing pump 524 is operated so as to send the development replenishing solution which is temporarily stored in the replenishing tank 518 to the developing tank 520. The developing tank 520 is replenished with as much development replenishing solution as the solution deteriorated due to the use for the process in the developing tank 520. This is also similarly carried out for the bleaching/fixing solution and the stabilizing solution.

When the level in the replenishing tank 518 reaches a predetermined amount or less, this is detected by the lower limit detecting switch 528. An instruction is displayed on the monitor 532 to supply the replenisher to the replenishing tank 518.

Next, when the replenisher is supplied to the replenishing tank 518, a procedure will be described.

(1) In the first place, the unlocking button 583 is pressed so as to open the outer cover 542 and the inner cover 544 of the replenishing section 536.

(2) Next, the processing agent container 534 is inverted so as to load the processing agent container 534 into the holder 556 of the inner cover 544 (see FIG. 14).

(3) Next, the outer cover 542 is closed.

Figure 16:
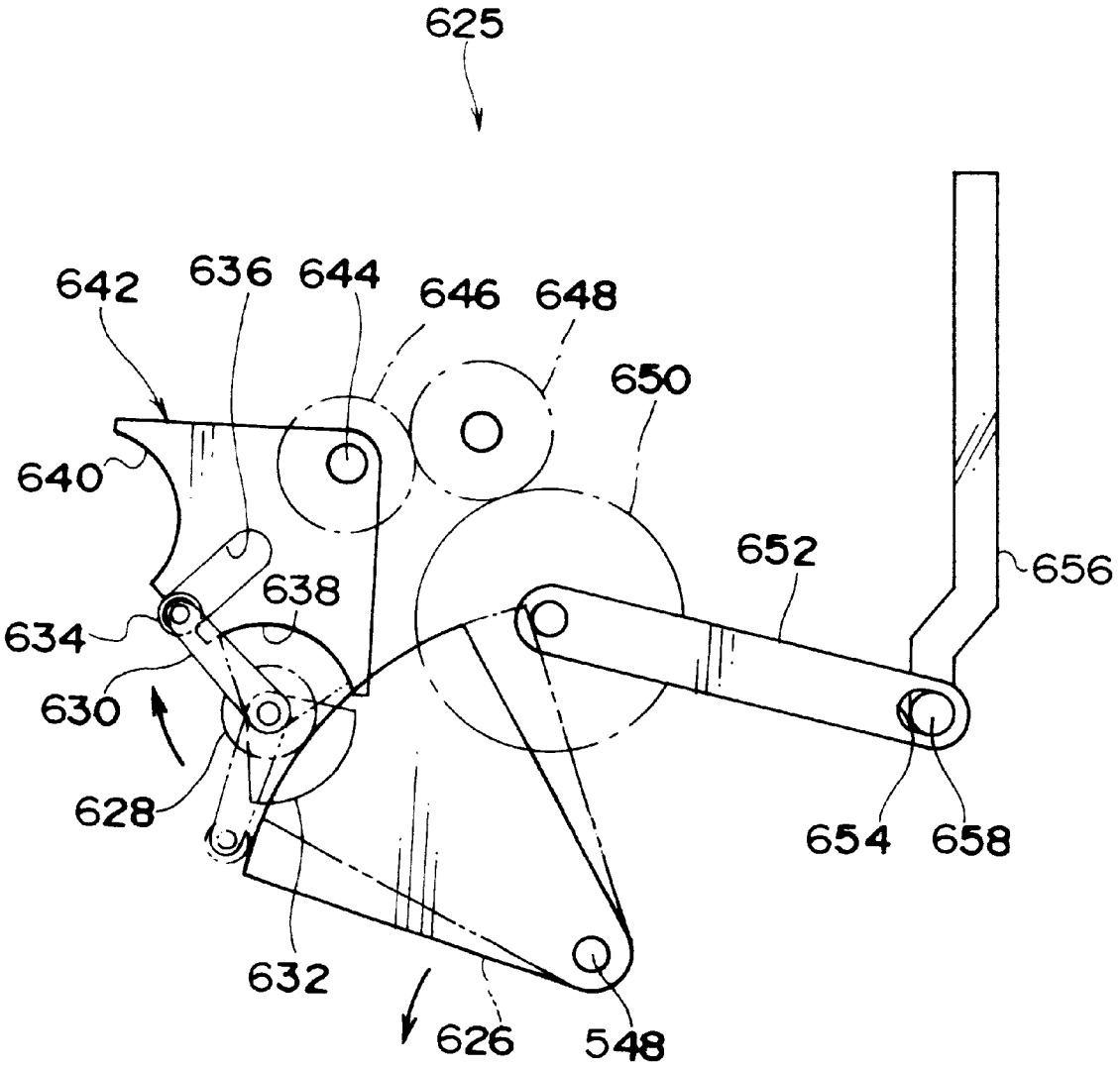
FIG. 16 is an enlarged view of a seal mechanism.

In the seal mechanism 625, when the outer cover 542 is completely opened as shown in FIG. 14 (at this time, the outer cover 542 is opened generally 30 with respect to the side surface of a casing 410A), the fan cam 632 enters the arc curved surface 638 of the driven member 642 as shown by a phantom line of FIG. 16.

When the outer cover 542 is being closed, the motion of the outer cover 542 is transmitted to the small gear 628 through the fan gear 626. As shown in FIG. 16, the fan cam 632 is spaced from the arc curved surface 638. The small roller 634 of the shaft arm 630 is also progressed into the groove 636 of the driven member 642. Until the small roller 634 of the shaft arm 630 is progressed into the groove 636 of the driven member 642, the driven member 642 is not rotated. Accordingly, the seal plate 656 is not moved.

Figure 17:
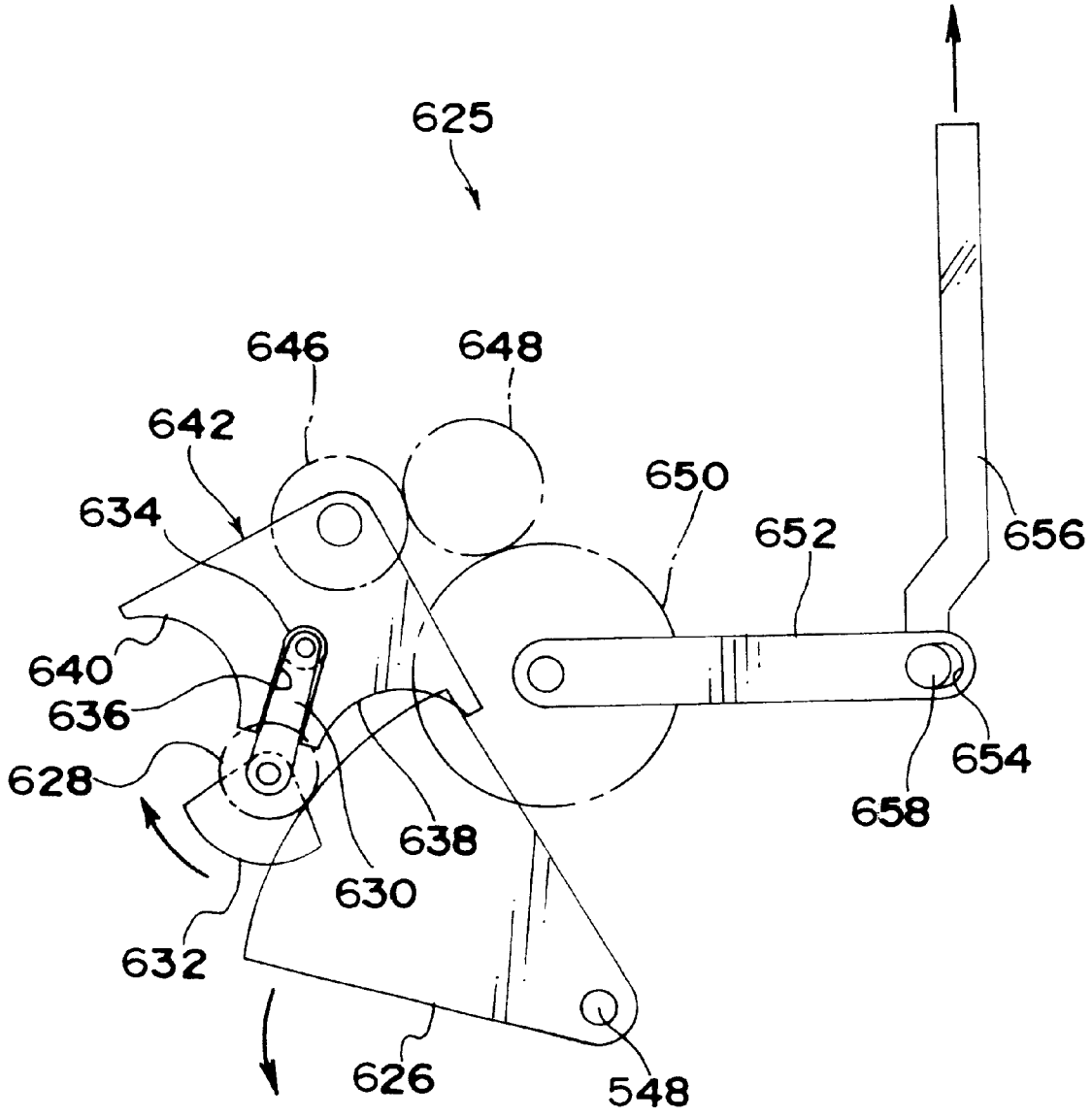
FIG. 17 is an enlarged view of the seal mechanism.

When the outer cover 542 is being further closed, as shown in FIG. 17, the motion of the shaft arm 630 is transmitted to the small roller 634, the groove 636, the driven member 642, the small gear 646, the small gear 648, the large gear 650 and the link 652. Thus, the seal plate 656 is moved upward.

Figure 18:
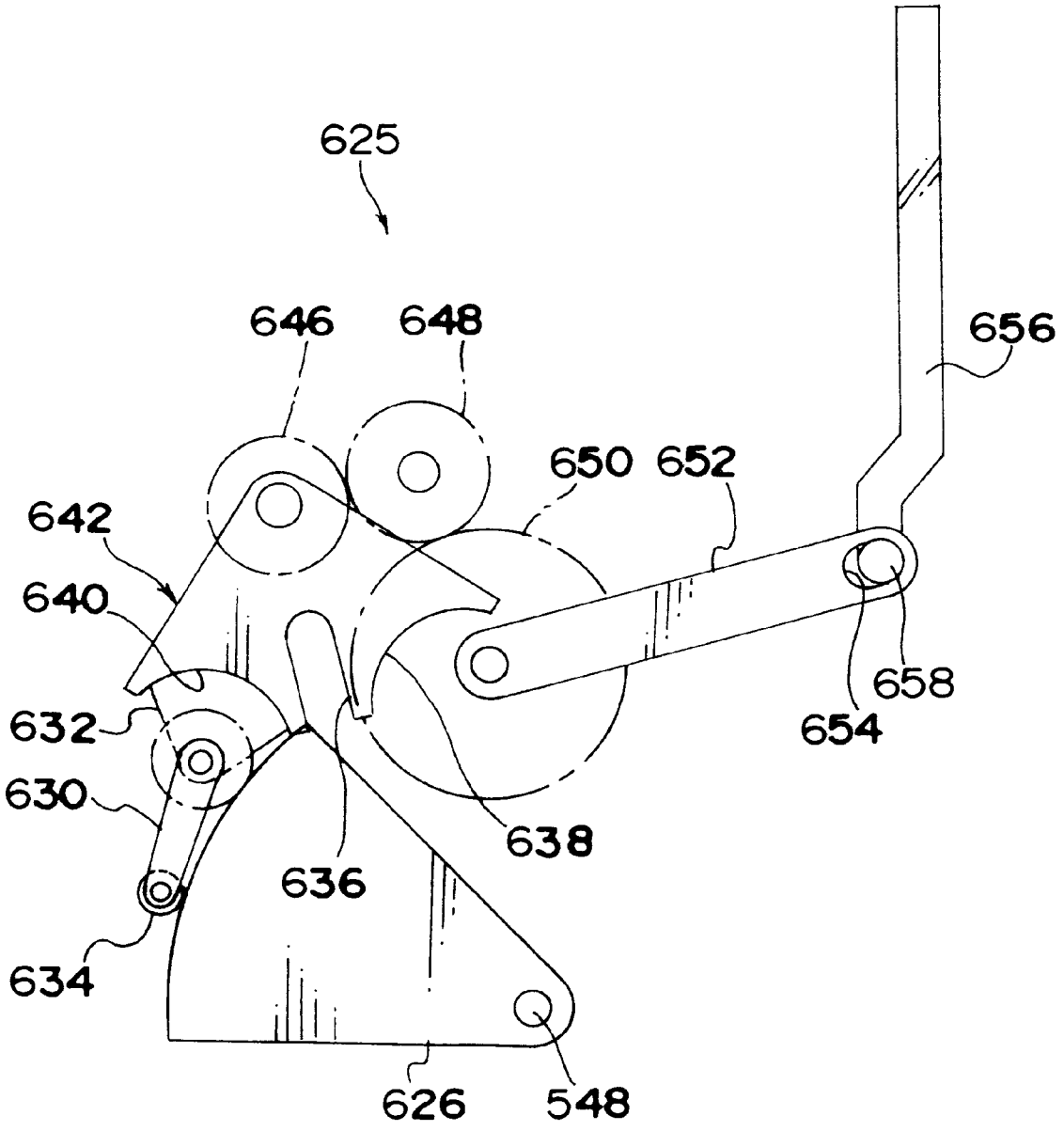
FIG. 18 is an enlarged view of the seal mechanism.

Next, while the outer cover 542 is being closed from about 15 to 0, the driven member 642 is further rotated, thereby further lifting the seal plate 656 plate upper end of the seal plate 656 is brought into contact with the lower end of the inner cover 544 so as to close the concavity 558. At that time, the small roller 634 of the shaft arm 630 is removed from the groove 636. The fan cam 632 also enters the arc curved surface 640. As shown in FIGS. 15 and 18, until the outer cover 542 is completely closed, the driven member 642 is not rotated and the seal plate 656 is not moved. The seal plate 656 is lifted, whereby it is possible to prevent a solution spatter toward the outside of the apparatus during the introduction of the replenisher.

Figure 19:
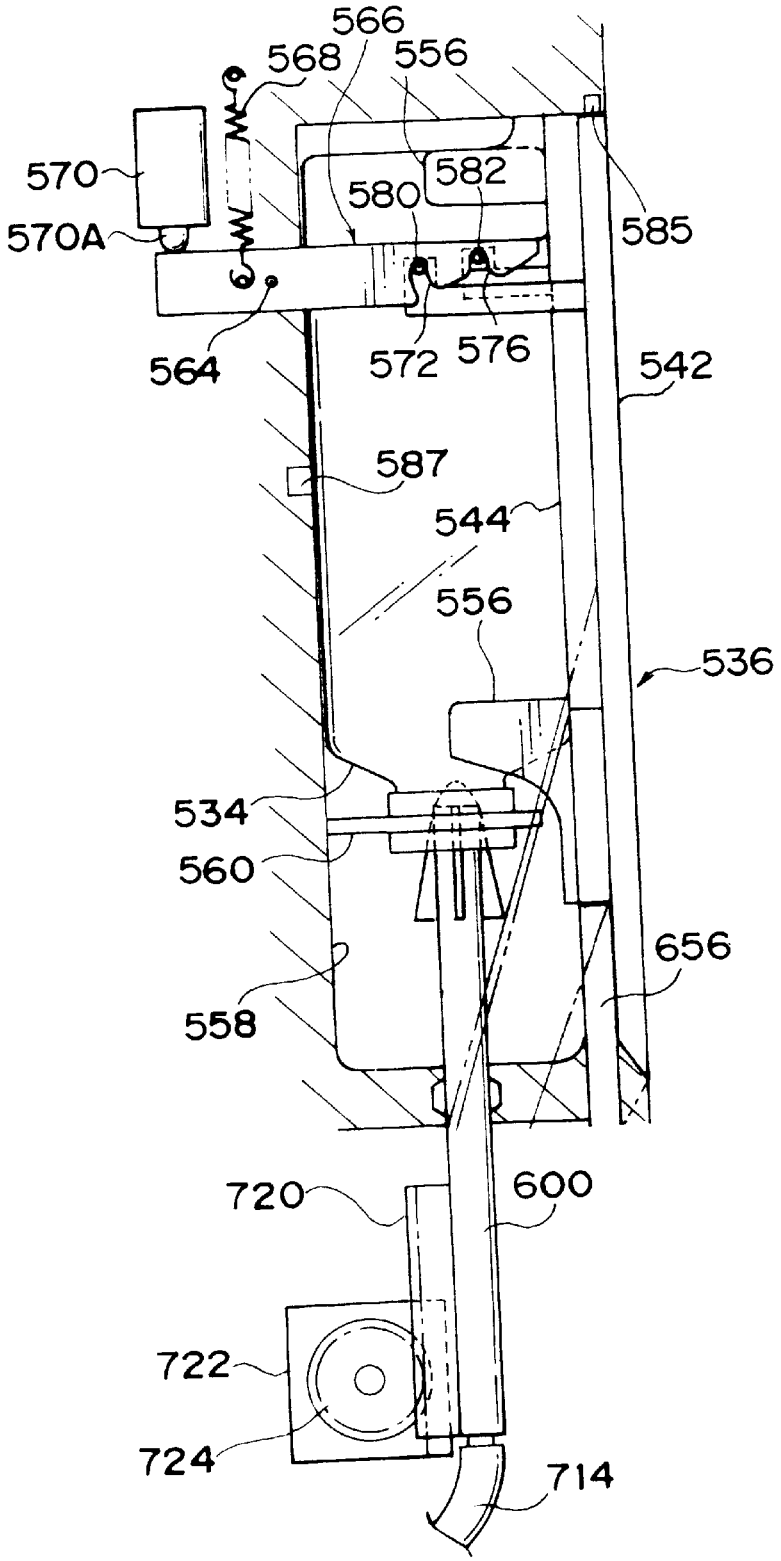
FIG. 19 is a cross-sectional view of the refilling section in a condition that the cap of the processing agent container is opened.

When the outer cover 542 is completely closed so as to turn on the switch 585, the motor 722 is rotated. As shown in FIG. 19, the unsealing member 600 is lifted so as to break the cap 538. Thus, the sealed processing agent or replenisher is introduced into the replenishing tank 518.

(4) After a predetermined time (the time required to approximately flow the processing agent from the container, the time is previously stored in the controlling device 530) passes from the turn of the switch 585, the electromagnetic valve 712 is opened. The pump 708 is operated for a predetermined time so as to clean the inside of the container with water.

(5) When the cleaning is completed, the controlling device 530 controls the motor 722 moving the unsealing member 600 in accordance with the temperature and the humidity of the environment.

In the embodiment, when the environment is in a condition of a high temperature (for example, 15° C. or more, preferably 20° C. or more) or/and a low humidity (for example, 50% or less, preferably 40% or less) after the cleaning, the unsealing member 600 remains inserted in the processing agent container 534. In this case, ambient air is easy to enter the processing agent container 534. The drying is promoted in the processing agent container 534. That is, the processing agent container 534 is efficiently dried. It is possible to prevent a liquid drip during a next supply (a removal of the container).

On the other hand, when the environment is in the condition of the low temperature or/and the high humidity after the cleaning, the unsealing member 600 is withdrawn from the processing agent container 534. In this case, ambient air is difficult to enter the processing agent container 534. The drying in the processing agent container 534 is difficult to promote. Since the unsealing member 600 is withdrawn at an early timing, it is easy to apply a restoring force of the breaking piece 538A of the cap 538. Thus, close properties of the cap 538 are excellent. That is, the close properties of the processing agent container 534 are increased, whereby the liquid drip can be prevented during the removal of the container.

When the outer cover 542 is in an opened state (detected by the switch 585) and the refilling solution is being introduced, even if the unlocking button 583 is pressed, the solenoid 570 is controlled so as not to be operated. Therefore, the inner cover 544 are not opened.

Other replenishers are supplied to a predetermined replenishing tank 518 in the same manner. Since the processing agent container 534 is dried in the replenishing section 536, the detection of the temperature and humidity in the replenishing section 536 would further improve an accuracy.

An additional vent hole or the like may be disposed so as to introduce outside air into the replenishing section 536. Thus, the processing agent container 534 can be more easily dried.

Embodiment 5

In the fourth embodiment, the operation of the unsealing member 600 is controlled in response to the conditions of the environment (temperature and humidity). In a fifth embodiment, the operation of the unsealing member 600 is also controlled in response to other conditions.

In the first place, the controlling device 530 detects the amount of cleaning water in the water tank 700.

When a small amount of cleaning water remains (when the level is detected by the lower limit detecting switch 704), the motor 722 for moving an unsealing member 600 is controlled so as not to be operated so that the cap 538 may not be opened. When a small amount of cleaning water remains, a display (warning) is shown on the monitor 532. This display is performed because, due to the shortage of the cleaning water during cleaning, the cleaning is required again, the drying of the container is not promoted and a cleaning efficiency is reduced. When the cleaning water is used as the diluting water for the processing agent or replenisher, a predetermined dilution cannot be performed. Therefore, the cleaning water is supplied so as to increase water in a cleaning water tank, thereafter allowing the cap 538 to be opened.

Next, when the level is high in the replenishing tank 518 (when the level is detected by the upper limit detecting switch 527), the motor 722 for moving the unsealing member 600 is controlled so as not to be operated. The cap 538 is not opened. The display (warning) is shown on the monitor 532.

That is, when the cap 538 is opened in this state, the replenishing tank 518 may be overflowed. Even if the overflow does not occur at the introduction of the processing agent or replenisher, when the cleaning water is used as the diluting water, there is a high possibility that the overflow is caused by the diluting water. Thus, the cap 538 is not opened.

When the cap 538 is opened and the container cleaning is in a stand-by state prior to the reduction of the level of the processing agent in the replenishing tank 518, the processing agent is tightly adhered to the processing agent container 534. This results in the deterioration of cleaning effect. Furthermore, since it takes much time to dry the container, this is not preferable.

In a case as described above, another method may be used in which the control is performed so that the unlocking cannot be performed so as not to open the outer cover 542 and the inner cover 544.

Next, when the processing agent containers 534 are not mounted on all the holders 556 of the inner covers 544 corresponding to the respective processing tanks, the cap 538 is not opened so that the display (warning) may be displayed on the monitor 532. This is performed in order to determine the timing for supplying the corresponding processing agent to each processing tank. When all the processing agent containers 534 are mounted, the caps 538 of all the processing agent containers 534 are opened. Thus, it is possible to reduce the number of times of the supply. It is easier to use the apparatus.

Whether or not the processing agent container 534 is being loaded is detected by the switch 587.

What is claimed is:

1. A processing agent introducing apparatus for use in a photosensitive material processing apparatus processing a photosensitive material, comprising:

a reservoir tank for reserving processing agent;

holding means for holding a container in which the processing agent is contained while a sealed opening of said container is directed downward; and an unsealing member for unsealing said sealed opening to flow the processing agent contained in said container into said reservoir tank, wherein said unsealing member has a plurality of jet openings jetting a cleaning liquid onto an inner wall of said container in different directions, each direction being set in one of a range of 45° or less and a range of 90° or more with respect to one of a center axis of said unsealing member and a center axis of said container held by said holding means.

2. The processing agent introducing apparatus according to claim 1, wherein one of said plurality of jet openings jets the cleaning liquid along a center axis of said unsealing member or the center axis of said container.

3. The processing agent introducing apparatus according to claim 1, wherein said unsealing member can be inserted into and withdrawn from said sealed opening of said processing agent container.

4. The processing agent introducing apparatus according to claim 1, wherein said unsealing member comprises a whirling member which generates a turbulent flow and centrifugal force for the cleaning liquid, and the openings of said unsealing member are tapered.

5. A processing agent introducing apparatus for use in a photosensitive material processing apparatus processing a photosensitive material, for unsealing a sealing member of a processing agent container to introduce processing agent for replenishment filled in the processing agent container into a replenishing tank, comprising:

a load section which is loaded with said processing agent container;

an unsealing member for unsealing said sealing member;

driving means for moving at least one of said loading section and said unsealing member, for inserting said unsealing member into said processing agent container through the sealing member and for withdrawing said unsealing member from said processing agent container; and controlling means for controlling said driving means based on an operation condition of the photosensitive material processing apparatus.

6. A processing agent introducing apparatus for use in a photosensitive material processing apparatus processing a photosensitive material, for unsealing a sealing member of a processing agent container to introduce processing agent for replenishment filled in the processing agent container into a replenishing tank, comprising:

a load section which is loaded with said processing agent container;

an unsealing member for unsealing said sealing member;

driving means for moving at least one of said loading section and said unsealing member, for inserting said unsealing member into said processing agent container through the sealing member and for withdrawing said unsealing member from said processing agent container;

environment detecting means for detecting an environment condition; and controlling means for, after the sealing member is unsealed by said unsealing member, controlling the withdrawal of said unsealing member from said processing agent container in response to the environment condition detected by said environment detecting means.

7. The processing agent introducing apparatus according to claim 6, wherein said controlling means controls said driving means so that said unsealing member may be withdrawn from said processing agent container after unsealing when the environment condition detected by said environment detecting means is in a condition of a low temperature and/or a high humidity.

8. The processing agent introducing apparatus according to claim 6, wherein said controlling means controls said driving means so as to maintain a condition that said unsealing member is inserted in said processing agent container after unsealing when the environment condition detected by said environment detecting means is in a condition of a high temperature and/or a low humidity.

9. A processing agent introducing apparatus for use in a photosensitive material processing apparatus processing a photosensitive material, for unsealing a sealing member of a processing agent container to introduce processing agent for replenishment filled in the processing agent container into a replenishing tank, comprising:

a load section which is loaded with said processing agent container;

an unsealing member for unsealing said sealing member;

driving means for moving at least one of said loading section and said unsealing member, for inserting said unsealing member into said processing agent container through the sealing member and for withdrawing said unsealing member from said processing agent container;

cleaning means for cleaning the inside of said processing agent container with cleaning liquid;

a cleaning liquid tank for reserving said cleaning liquid;

cleaning liquid level detecting means for detecting a level of said cleaning liquid in said cleaning liquid tank; and controlling means for prohibiting the operation of said driving means when the level of said cleaning liquid in said cleaning liquid tank is a predetermined level or less.

10. A processing agent introducing apparatus for use in a photosensitive material processing apparatus processing a photosensitive material, for unsealing a sealing member of a processing agent container to introduce processing agent for replenishment filled in the processing agent container into a replenishing tank, comprising:

a load section which is loaded with said processing agent container;

an unsealing member for unsealing said sealing member;

driving means for moving at least one of said loading section and said unsealing member, for inserting said unsealing member into said processing agent container through said sealing member and for withdrawing said unsealing member from said processing agent container;

cleaning means for cleaning the inside of said processing agent container by cleaning liquid;

a reservoir tank for reservoiring said processing agent;

processing agent level detecting means for detecting a level of said processing agent in said reservoir tank; and controlling means for prohibiting the operation of said driving means when the level of said processing agent in said reservoir tank is a predetermined level or more.

11. A processing agent introducing apparatus for use in a photosensitive material processing apparatus processing a photosensitive material, for opening a sealing member of a processing agent container to introduce processing agent for replenishment filled in the processing agent container into a replenishing tank, comprising:

a plurality of load sections, each of which is loaded with said processing agent container;

an unsealing member for opening said sealing member;

driving means for moving at least one of said load section section and said unsealing member, for inserting said unsealing member into said processing agent container through said sealing member and for withdrawing said unsealing member from said processing agent container;

container detecting means for detecting whether or not said processing agent container is loaded in each of said plurality of load sections; and controlling means for prohibiting the operation of said driving means while it is not detected that said processing agent container is loaded in each of said plurality of loading sections.

12. The processing agent introducing apparatus according to claim 5, wherein said unsealing member has a plurality of jet openings jetting the cleaning liquid for cleaning the inner wall of said processing agent container in different directions.

13. The processing agent introducing apparatus according to claim 12, wherein one of said plurality of jet openings jets the cleaning liquid along the center axis of said unsealing member or the center axis of said processing agent container.

14. The processing agent introducing apparatus according to claim 13, wherein the direction to jet the cleaning liquid is set in the range of 45° or less and/or of 90° or more with respect to the center axis of said unsealing member or the center axis of said processing agent container held by said holding means.

15. The processing agent introducing apparatus according to claim 6, wherein said unsealing member has a plurality of jet openings jetting the cleaning liquid for cleaning the inner wall of said processing agent container in different directions.

16. The processing agent introducing apparatus according to claim 15, wherein one of said plurality of jet openings jets the cleaning liquid along the center axis of said unsealing member or the center axis of said processing agent container.

17. The processing agent introducing apparatus according to claim 16, wherein the direction to jet the cleaning liquid is set in the range of 45 or less and/or of 90 or more with respect to the center axis of said unsealing member or the center axis of said processing agent container held by said holding means.

18. The processing agent introducing apparatus according to claim 1, wherein every one of said plurality of jet openings is for jetting a cleaning liquid onto an inner wall of said container.

* * * * *